US007455401B2

(12) United States Patent
Koto et al.

(10) Patent No.: US 7,455,401 B2
(45) Date of Patent: Nov. 25, 2008

(54) LINE-DOT RECORDER

(75) Inventors: Haruhiko Koto, Koganei (JP); Hirofumi Tsuji, Sanda (JP); Hiroyuki Santo, Sanda (JP); Masaru Nakano, Sanda (JP); Osamu Satake, Sanda (JP); Makoto Miyaji, Osaka (JP)

(73) Assignee: Hamada Printing Press Co., Ltd., Osaka (JP)

( * ) Notice: Subject to any disclaimer, the term of this patent is extended or adjusted under 35 U.S.C. 154(b) by 0 days.

(21) Appl. No.: 10/573,046

(22) PCT Filed: Sep. 21, 2004

(86) PCT No.: PCT/JP2004/013750

§ 371 (c)(1),
(2), (4) Date: Jun. 22, 2006

(87) PCT Pub. No.: WO2005/028206

PCT Pub. Date: Mar. 31, 2005

(65) Prior Publication Data

US 2007/0035569 A1 Feb. 15, 2007

(30) Foreign Application Priority Data

Sep. 24, 2003 (JP) ..... 2003-331999
Sep. 6, 2004 (JP) ..... 2004-258853
Sep. 6, 2004 (JP) ..... 2004-258859

(51) Int. Cl.
*B41J 2/01* (2006.01)

(52) U.S. Cl. ..... 347/104; 347/101

(58) Field of Classification Search ..... 347/104, 347/101; 346/138; 400/659–662
See application file for complete search history.

(56) References Cited

U.S. PATENT DOCUMENTS 4,352,671 A * 10/1982 Petersen ..... 493/424
5,517,222 A * 5/1996 Sugiyama et al. ..... 347/35
5,757,399 A 5/1998 Murayama et al.
5,980,136 A * 11/1999 Teumer et al. ..... 400/521

(Continued)

FOREIGN PATENT DOCUMENTS

JP 3-227646 10/1991

(Continued)

*Primary Examiner*—Matthew Luu
*Assistant Examiner*—Henok Legesse
(74) *Attorney, Agent, or Firm*—Wenderoth, Lind & Ponack, L.L.P.

(57) ABSTRACT

A line dot recorder which prevents the throughput (print time per sheet) from lowering (time lengthens) in multi-pass dot recording in a predetermined print area on the printing medium being moved by a rotary drum, thereby forms high-quality images efficiently on a plurality of printing papers.

The line dot recorder A includes a nozzle head 1 as a recording head having recording elements in the form of a plurality of ink orifices (nozzles) of an inkjet system, a rotary drum 2 having its outer periphery close to the recording head, a paper feed means 3 for supplying paper to the drum, a mounting/holding means 4 for mounting four papers on the drum, and a paper delivery means 5 for delivering paper, and can form high-quality images while eliminating the lowering of throughput by dot recording by a 4-pass multi-pass system in the sub-scanning direction while rotating the drum at quadruple speed and forming images by four rotations of the drum.

24 Claims, 32 Drawing Sheets

U.S. PATENT DOCUMENTS

| | | | | |
|---|---|---|---|---|
| 6,070,977 | A * | 6/2000 | Nuita et al. | 347/104 |
| 2002/0039507 | A1* | 4/2002 | Kawasumi et al. | 399/388 |
| 2003/0234851 | A1* | 12/2003 | Booth et al. | 347/104 |

FOREIGN PATENT DOCUMENTS

| | | |
|---|---|---|
| JP | 4-366645 | 12/1992 |
| JP | 7-152259 | 6/1995 |
| JP | 11-115220 | 4/1999 |
| JP | 2001-018374 | 1/2001 |
| JP | 2002-011865 | 1/2002 |
| JP | 2002-103638 | 4/2002 |
| JP | 2003-62989 | 3/2003 |

* cited by examiner

LINE-DOT RECORDER

TECHNICAL FIELD

This invention relates to a line dot recorder which prints efficiently on a printing medium (paper) mounted on the outer periphery of a rotary member by recording dots of an inkjet system from recording elements in the form of a plurality of inkjet orifices arranged in lines.

BACKGROUND TECHNOLOGY

As printing systems in which images are formed and printed on a printing medium (paper) by jetting liquid dots from an inkjet head, known systems include a serial print system in which a recording head of an inkjet type having a plurality of inkjet nozzles is mounted on a carriage so as to be reciprocal and a paper is fed little by little in a perpendicular direction (sub-scanning direction) for recording while scanning the inkjet head in a widthwise (main-scanning) direction of the paper (of regular size), and a line print system in which inkjet nozzles are arranged in a line on a recording head of an inkjet system so as to correspond to one line of the paper and recording is performed while scanning in a paper feed direction with the recording head kept standstill.

Among them, high-speed printing is possible with printers of the line print system, which are used as an on-demand inkjet line printer. Not to mention with the serial print system, with the inkjet recording system using an inkjet line printer, a dot recording method of a multi-pass system is generally adopted in which thin-out images are recorded with time lags to prevent the image from deteriorating due to uneven density or ink blurring. Various proposals have been made to improve the image quality in forming images.

The deterioration of image quality with an inkjet line printer is caused by unevenness in the volume and direction of ink jetted from the ink nozzles with the nozzles and resulting unevenness in the size and position of dots. Unevenness in the dot position results in poor uniformity of the distance between dots. The smaller the distance, the higher the density whereas the larger the distance, the lower the density. Sometimes a white stripe appears, thus impairing image quality. Also, unevenness in the dot size causes the difference in the density between the adjacent dots, forming stripes and thus deteriorating the image quality.

As a dot recording method for preventing the deterioration of image quality, patent publication 1 (Japanese patent publication 10-138520) discloses a method of dot recording an image with two or four rotations of the rotary drum. With the method of printing with two rotations of the rotary drum, jet nozzles of a number corresponding to the pixel number in the main scanning direction to be printed on the paper mounted on the drum are arranged in the main scanning direction, dot recording is done with the first rotation of the drum on the paper moving with the rotation of the drum from the nozzles on every other line in the main scanning direction, and dot recording is performed with the second rotation of the drum from the nozzles in the remaining lines.

With the method of printing with four rotations of the drum, dot recording is done with the first rotation of the drum every other dot in the main scanning direction and every other dot in the sub-scanning direction, too, with the second rotation in spaces between the dots, with the third rotation in the blank portions in the main scanning direction, and with the fourth rotation in the blank portions in the sub-scanning direction, so that all the pixels are recorded with four rotations of the drum. With such a dot recording method, the ink drying time can be prolonged until dot recording for all the dots is complete. Thus it is suited for high quality printing rather than high speed printing.

The patent publication 2 discloses a dot recording method in which the recording heads are arranged so as to be movable in the main scanning direction and the jet nozzles are arranged at a pitch twice the pixels to be recorded, and dot recording is done with the first rotation of the drum every other dot in the main scanning direction and every other dot in the sub-scanning direction, too, and with the second rotation of the drum dot recording is done with the recording head moved by one dot so that the recording position for the basic resolution of dot will be shifted between the even number lines and the odd number lines in the main scanning direction. This dot recording method is said to be effective to reduce the formation of stripe-like unevenness in density in printing requiring intermediate graduation.

The patent publication 3 discloses a dot recording method by multi-pass printing using a jet nozzle printer of a serial print system. With this dot recording method, a plurality of jet nozzles are arranged in a direction perpendicular to the scanning direction of a carriage which moves in a widthwise direction of the paper. With this dot recording method, various multi-pass multiple speed printings are possible from 2-pass double speed printing to 4-pass quadruple speed printing. With this method, by setting the scan speed for the second recording mode higher than that for the first recording mode, double speed or quadruple speed printing is possible.

The dot recording methods disclosed in Patent publications 1 and 2 are multi-pass dot recording methods in which a drum is rotated and a plurality of jet nozzles are arranged in the main scan direction, but they mainly aim to prevent the deterioration of quality and prevent unevenness in density and ink blurring by dot recording the remaining pixels passed in two or four rotations of the drum with some time delays. They are not designed for dot recording or printing at double or quadruple speed.

The Patent publication 3 discloses a dot recording method of serial print type, multi-pass system which permits high-speed printing such as double or quadruple speed in the main scanning direction. But, with the serial print system, inkjet nozzle heads carried on a carriage are moved for dot recording, and each nozzle head is provided with a plurality of nozzles, but the length of the nozzle head is limited to several fractions of the width of the paper. So a plurality of nozzles are provided, but the number is much less than on a line printer. Therefore, its speed is limited to double or quadruple speed.

If one intends to apply the multi-pass dot recording method for a serial printer to a line printer with a rotary drum, it is not applicable because a serial printer is not a rotary drum type. Also, a single paper is mounted on the rotary drum of the line printer disclosed in the Patent publications 1 and 2. So it is not possible to dot record and print continuously and efficiently on a plurality of papers.

Another reason why the multi-pass dot recording method for a serial printer is not applicable to a line printer with a rotary drum is that if the number of passes is increased to improve the clearness of the image in high-speed printing such as double or quadruple speed with a serial printer, the number of times of scanning of the nozzle head would increase, so that the throughput (printing time per sheet) increases considerably. On the other hand, because a line printer with a rotary drum is designed for high-speed mass-printing, such a system requiring long throughput is not applicable to high-speed printing.

If the scanning speed of the carriage of the nozzle head was increased to prevent the throughput from decreasing, the carriage would have to move at ultra-high speed and the acceleration and the deceleration at both ends of its travel would become extremely large. This would require a mechanical structure that can withstand large acceleration and deceleration. This would make the apparatus bulky and the manufacturing cost would increase so as to increase the strength and accuracy. The durability would decrease if the strength and accuracy are not increased. Also, because the areas for acceleration and deceleration are needed for the travel of the carriage, stroke ranges which do not contribute the formation of images have to be provided at both ends of the stroke which is needed for the formation of images. If the scanning speed is increased to keep low the deceleration, the strokes at both ends would be remarkably large.

Such an increase of the acceleration and deceleration at both ends of carriage travel can cause trouble in a smooth supply of ink from the ink tank in the nozzle head to the nozzles. Also, moving the carriage at high speed and accelerating and decelerating it increases the vibration and noise of the apparatus. One approach is to keep the nozzle heads standstill or move them at such a low speed as not to cause such problems and perform multi-pass dot recording in the sub-scanning direction at high speed such as double or quadruple speed on a plurality of papers mounted on a rotary drum. But such an approach has not been proposed.

On the other hand, returning to the deterioration of quality, the first cause is that the volume (amount) of ink jetted from the nozzles and the ink jet direction are not uniform but uneven.

With an inkjet line printer provided with a line head having many nozzles arranged in lines, particularly a line head having short heads mounted in staggered fashion (e.g. carriage 10 used in FIGS. 3, 15 and 28 in the embodiments), stripe-like unevenness can appear at portions between the short heads due to a difference in the scanning direction (perpendicular to the drum rotating direction) of the short heads.

As one solution of this problem, Patent publication 4 discloses a color inkjet printer for color printing by a line head on a paper mounted on a rotary drum. This printer has a line head arranged opposite to the rotating surface of a drum on which a printing medium is mounted, the line head having short heads arranged in staggered fashion so as to be perpendicular to the drum rotating direction. The printer completes one image by printing (image recording) a plurality of times.

Namely, printing (recording) is done every n−1 (n>2) pixel in at least one of the main scanning direction and sub-scanning direction, and in one printing (one rotation) in the main scanning direction ink is jetted from every n−1 (n>2) nozzle. In printing, recording is done so as for dots not to overlap, thereby suppressing unevenness resulting from the mixing of ink or wetting of printing paper. Further, by moving the line head in the main scanning direction, unevenness in printing due to misfired nozzles and a difference between dots with nozzles is dispersed, thereby improving the image quality by multi-pass system.

With such an inkjet printer, if the moving distance in moving the line head in the main scanning direction can be increased, it is possible to increase the effect of multi-pass in improving the quality and achieve high image quality printing. This is because if unevenness is formed due to non-printing by misfired nozzles, small moving distance of the line head results in insufficient dispersion of unevenness, thus making unevenness noticeable to the human eye.

However, the larger the moving distance, the longer time is taken for moving the head. Also, it is required that movement of the head be started after printing (image recording) is complete and it ends before the next printing starts. Therefore, the speed of the drum is regulated by the moving speed of the head. So the drum speed had to be decreased. This makes high speed printing impossible.

Increasing the moving speed of the line head is considered to be one solution. But, increasing the head speed would apply undue force to the ink in the head (like the above serial printer), thus impairing the inkjet performance by the effect of change in pressure in the ink tank and making high-image quality printing impossible.

Other causes of deterioration of image quality are as follows.

Inkjet printers, one of the line dot recorders, jet fine ink particles from inkjet nozzles of a micron size to paper for printing. Therefore, inkjet printers are liable to cause deterioration of print image due to clogging of inkjet nozzles with ink or dust. Particularly, with line printers which have inkjet nozzles arranged in lines to print one line at one time, the number of inkjet printers requiring cleaning is large and the line heads are of a large size in comparison with those of serial printers. Various cleaning mechanisms have been proposed to solve these troubles.

For example, with the line printer disclosed in Patent publication 5, as shown in FIG. 33, the line head 1 has one end thereof supported by a pivoting shaft so that it can be turned by 90 degrees from its recording position to home position H for cleaning. After being moved, the line head 1 is subjected to cleaning by means of a cleaning unit U standing by the home position H. The cleaning unit U has a cleaning blade and a suction cap. Firstly the cleaning blade wipes the line head 1 to remove ink and dust clinging to the surface of the line head and then the suction cap is pressed against the line head to suck ink and dust out of the ink nozzles.

However, with this inkjet printer, nozzles for all colors are provided on a single line head. The line head that has to be turned is single, but, in order to perform printing with high accuracy at high speed, the number of nozzles has to be increased. Therefore, if one line head is provided for each color, at least four (eight if the line heads are divided into two groups like embodiment 2 in Patent publication 5) line heads 1 have to be turned. This can cause the line heads to butt each other in turning. Also, a complicated mechanism becomes necessary to avoid collision of the line heads. Another problem is that a large space is required to turn a plurality of line heads.

Further, with this inkjet printer, ink is supplied from an ink cartridge mounted on the line head 1. If an external tank is used, the piping from the external tank to the line head 1 will be needed by the same number as the number of the line heads. Since the line heads have to be turned, the piping to the line heads will be difficult to arrange.

[Patent publication 1] Japanese patent publication 2001-18374

[Patent publication 2] Japanese patent publication 11-115220

[Patent publication 3] Japanese patent publication 4-366645

[Patent publication 4] Japanese patent publication 2002-11865

[Patent publication 5] Japanese patent publication 2002-103638

SUMMARY OF INVENTION

Problem To Be Solved

An object of this invention is to provide a line dot recorder with which high-quality images can be formed efficiently on a plurality of printing medium by preventing the throughput (printing time per sheet) from decreasing (time lengthens) in forming images by multi-pass dot recording on the print area on the printing medium moved by a rotary drum.

The second object of this invention is to provide a line dot recorder which has the above-mentioned features and can feed and deliver a plurality of printing medium continuously and can form images with uniform quality on each of the plurality of printing medium.

Another object of this invention is to provide a line dot recorder which has generally the same structure as described above and forms images on a plurality of printing medium with high efficiency (time throughput) which is in terms of the number of sheets printed per unit time (e.g. per second).

The fourth object of this invention is to improve a line dot recorder toward high image quality printing at high speed.

The fifth object of this invention is to provide a relatively simple mechanism for cleaning a high-chroma accuracy, high-speed line dot recorder provided with a plurality of line heads.

Means for Solving Problems

As a means for solving the first object, the present invention provides a line dot recorder comprising a rotary drum having an outer periphery of a sufficient length to mount a printing medium thereon, a drum driving means for rotating the rotary drum, and a recording head provided close to the outer periphery of the rotary drum and having a plurality of recording elements in the form of jet nozzle orifices arranged in lines in the main scanning direction at intervals corresponding to a predetermined pixel density in a proper print area, wherein the rotary drum has an outer periphery of a length which is N (an integer of two or more) times the base length which is the length in the sub-scanning direction of the printing medium and is sufficient to mount and hold N sheets of the printing medium, and the rotary drum is rotated to move the printing medium relative to the recording head in the sub-scanning direction at such a speed over a standard speed that dot recording to pixels of the printing medium of a regular length will be done with a predetermined pixel density at the operating period of the recording head, and dot recording to the pixels is carried out by N-pass printing with N rotations of the rotary drum to form images on the printing medium.

With the line dot recorder according to this invention of the above-mentioned structure, it is possible to form high-quality images efficiently without lowering the throughput (printing time per sheet lengthens) by multi-pass system on the print area on a plurality of printing medium mounted on the rotary drum. But, if dot recording is performed by a recording head with a predetermined pixel density while rotating the rotary drum at a conventional standard speed, not a higher speed than that, dots are recorded one after another on pixels in the sub-scanning direction consecutively and adjacently to one another. If this dot recording is performed by N-pass printing system, dot recording will be done every N pixel. This requires N times the time to dot record on all the pixels on N sheets of paper, thus decreasing the throughput.

Therefore, if the drum rotating speed (peripheral speed) is increased to some times the standard speed during N-pass printing, lowering in throughput can be prevented. For example, if it is increased to N times the standard speed, the recording time for each pixel every N pixel will be 1/N time. This means that the recording speed will return to the original speed for N sheets of printing medium. Thus it is possible to eliminate lowering of speed due to the increase in the number of printing paper, that is, lowering of throughput, thereby making possible high-quality recording efficiently while operating the head at the highest operating frequency. Dot recording by N-pass system on one sheet means that by each rotation, dot recording is done on the pixels between first and N-th pixels on each printing paper and by N rotations of the drum dot recording is complete for all pixels on N sheets.

The variable N for N sheets of printing medium, N rotations of the drum and N-pass printing is an integer which is 2 or more. But, the speed over the standard drum speed includes not only N times the standard speed, but also any speed over the standard speed actual number m over 1) and which is effective to improve the throughput in comparison with the standard speed. Namely, it is not only N times but also may be an actual number larger than the standard speed such as 1.5 times and 3.8 times.

In order to form uniform, clear images to each pixel of each of N sheets of paper with the line dot recorder, it is preferable to couple a head moving means with the recording head to move the recording head relative to the rotary drum in the main scanning direction and the opposite direction for dot recording to each of the pixels. This is because there are subtle differences in shape and size from nozzle to nozzle. The recording head is moved to make uniform such differences. But, the moving distance, moving time, reversal time, acceleration and deceleration may be set to values necessary for N-sheets, N rotation, speed over the standard speed, and N-pass printing. They do not have to be set on a large scale as in the serial print system.

In the above-mentioned line dot recorder which prints on N sheets of paper mounted on the drum by N-pass print system at a speed higher than the regular speed by N rotations, for continuous dot recording, it is necessary to provide paper feed means, paper mounting/holding means and paper delivery means. For this purpose, according to this invention, a paper supply means for supplying a paper to the rotary drum at a predetermined paper supply position every predetermined revolutions of the rotary drum, a paper mounting/holding means for mounting and holding N sheets of printing medium on the rotary drum, and a paper delivery means for delivering the mounted printing medium at a predetermined paper delivery position every predetermined revolutions of the rotary drum are provided, thereby supplying, mounting, holding and delivering a plurality of printing medium to and from the rotary drum one after another at predetermined timings, and forming uniform-quality images continuously on the plurality of printing medium.

With such a structure, it is possible to feed a plurality of printing medium continuously (at uniform intervals) to the drum at predetermined timings and form images of uniform quality on each printing medium. In this case, dot recording may be performed on a plurality of printing medium by operating nozzles of different recording elements so that the order of printed images will be the same, or by operating the same nozzles so that the order of printed images will be different. In either case, the printed images on all the N sheets of printing medium will be uniform.

As a means for solving the third object, this invention provides a line dot recorder comprising a rotary drum having an outer periphery of a sufficient length to mount a printing medium thereon, a drum driving means for rotating the rotary drum, and a recording head provided close to the outer periphery of the rotary drum and having a plurality of recording elements in the form of jet nozzle orifices arranged in lines in the main scanning direction at intervals corresponding to a predetermined pixel density in print area to be printed, wherein the rotary drum has an outer periphery of a length which is N (an integer of two or more) times the base length which is the length in the sub-scanning direction of the printing medium and is sufficient to mount N sheets of the printing medium, and dot recording to the pixels is carried out by N-pass printing with N rotations of the rotary drum to form images on the printing medium, and further comprising a paper supply means for supplying a paper to the rotary drum at a predetermined paper supply position, a paper mounting/holding means for mounting and holding N sheets of the printing medium on the rotary drum, and a paper delivery means for delivering the mounted printing medium at a predetermined paper delivery position, and wherein paper supply by the paper supply means and paper delivery by the paper delivery means are carried out to the rotary drum once per (1+1/N) rotation of the rotary drum.

With the line dot recorder of such a structure, paper feed and paper delivery are carried out by a paper feed means and a paper delivery means, respectively, once per (1+1/N) rotation of the drum.

By dot recording while feeding and delivering paper to and from the drum at uniform time intervals described above, the efficiency (time throughput) in terms of the number of sheets printed per unit time (e.g. per second) for a certain drum speed does not lower even if a plurality of papers are mounted on the drum, so that the print quality can be improved without lowering the time efficiency for the drum rotating speed.

Also, in order to solve the above-mentioned problem, the present invention provides a line dot recorder comprising a drum having a rotating surface on which a sheet of printing paper is mounted, and a line head arranged so as to oppose the rotating surface of the drum and having recording elements in the form of jet nozzle orifices arranged in lines so as to be perpendicular to the rotating direction of the drum, whereby printing by means of the line head on the printing paper mounted on the drum which is being rotated, wherein the line head is supported so as to be movable in a direction perpendicular to the rotating direction, and the drum can mount a plurality (N) of sheets of the printing paper on its rotating surface, but (N−1) sheets of the printing paper are mounted on the rotating surface of the drum to form a blank area where no printing paper is mounted, and by use of the blank area the line head is moved in the perpendicular direction for printing.

By adopting such a structure, the line head is moved each time the drum rotates so that a plurality of printing papers mounted on the drum are printed with different nozzles for each rotation of the drum. This makes it possible to reduce the effect of unevenness of dots due to misfiring or unevenness between the nozzles. Because the blank area is a paper-free area formed on the rotating surface of the drum and having a size of larger than one paper, if the line head is moved at a relatively slow speed without lowering the drum speed, it is possible to prevent undue pressure from being applied to the ink in the line head, thus preventing the jetting performance from lowering.

The line head may comprise a plurality of line heads for each color ink, and the line head for each color comprises a plurality of line head units, and for each line head for each color ink or for each line head unit forming the line head, the line head or the line head unit for each color is moved when it reaches the blank area or a portion adjacent to the blank area where no printing is to be done.

By adopting such a structure, the movement of the line head may be started the instant the end of the paper or the blank portion where no printing is to be done has passed under the line head for each color or the line head unit forming a line head and may be ended just before the tip of the next paper comes. Therefore, each line head or each line head unit can make use of the blank area equally for their movement.

The drum may be of such a size as to mount N sheets of printing paper on its rotating surface and multi-pass printing may be done in which printing on one paper is complete by N times of printing, that is, by N rotations of the drum.

By adopting such a structure, printing on one paper is completed by rotating the drum N times. So printing is done with different nozzles on the line head for each rotation of the drum. This reduces the effect of unevenness in jetting due to misfiring or unevenness between the nozzles.

Also, to solve the above-mentioned problem, this invention provides a line dot recorder comprising a drum having a rotating surface on which a sheet of printing paper is mounted, a line head having recording elements in the form of jet nozzle orifices arranged in lines so as to be perpendicular to the rotating direction of the drum, and a tray provided so as to be inserted between the drum and the line head for cleaning the line head, wherein the tray is provided in parallel with the shaft of the drum and a translating means is provided for inserting the tray between the drum and the line head and pulling out the tray.

By adopting such a structure, ink for cleaning jetted from the inkjet nozzles on the line head is received by the tray inserted between the line head and the drum. This makes it possible to clean the line head with a simple mechanism in comparison with the system in which the line head is pivoted. Also, this system can cope with a plurality of line heads.

If the tray provided with an ink absorbing unit formed of mesh is adopted, the mesh can receive the cleaning ink drops jetted from the inkjet nozzles, thus preventing the ink from scattering.

By arranging the tray in parallel with the shaft of the drum and providing a translating means, the tray can be inserted into between the line head and the drum by translating it. With such a structure, the tray is translated without inclining. So the angle of the tray will not change from during maintenance to during printing. Even if ink still remains on the tray after maintenance, ink will not spill but be kept as it is.

Also, an elevating means for moving the line head vertically may be provided to expand the distance between the line head and the drum. This facilitates insertion and pulling-out of the tray.

Also, an elevating means may be a wing having a fulcrum shaft at both sides of which a plurality of line heads are arranged in parallel, and the wing may be opened and closed around the fulcrum shaft to expand the distance between the drum and the line head.

By adopting such a structure, expansion of the distance between the drum and the line head can be easily done by opening the wing around the shaft. Also, a large work space is obtained by expanding the distance between them. This facilitates checking the conditions of nozzle surfaces of the line head and manual maintenance of the nozzle surface. Thus this improves workability.

Also, a suction port may be provided at drum side end of the tray, and the suction port may be connected to a suction pump to suck ink from the nozzles of the line head.

EFFECT OF INVENTION

As described above in detail, the line dot recorder according to this invention includes a rotary drum to mount a printing medium thereon, and a recording head provided close to the outer periphery of the rotary drum and having a plurality of recording elements arranged in lines in the main scanning direction at intervals corresponding to a predetermined pixel density, and the rotary drum is rotated to move the printing medium at such a speed over a standard speed that dot recording to pixels will be done with a predetermined pixel density, and dot recording is carried out by N-pass printing with N rotations of the rotary drum to form images on the printing medium. Therefore it is possible to prevent the throughput from lowering in forming images by multi-pass recording and form high-quality images efficiently on the paper.

Also, the line dot recorder according to this invention comprises a head moving means coupled with the recording head for moving the recording head in the main scanning direction and an opposite direction, a paper supply means for supplying a paper to the rotary drum every predetermined revolutions of the rotary drum, a paper mounting/holding means for mounting and holding N sheets of printing medium on the rotary drum, and a paper delivery means for delivering the mounted printing medium every predetermined revolutions of the rotary drum to supply the printing medium continuously. Therefore, it is possible to print continuously at high speed while maintaining uniform print quality for each paper and perform mass-printing efficiently.

With the line dot recorder of a continuous supply system, by moving the recording head to N positions and dot recording with such recording elements that the order of print images will be the same, dot recording is performed on N sheets of paper with the same image order. Therefore, it is possible to make uniform color overlapping and color tint on each paper, therefore achieving uniform print quality. Also, by moving the recording head to N positions and printing with the same nozzles, it is possible to reduce the difference in color density and dot position due to the difference between the nozzles and make uniform color tint, thereby achieving uniform print quality.

With the line dot recorder in which paper supply and paper delivery are performed every (1+1/N) rotation of the drum by the paper supply means and the paper delivery means, it is possible to improve the print quality without lowering the time efficiency because paper is supplied at predetermined intervals and it is possible to simplify the structure because operation steps from paper supply to paper delivery are repeated at uniform intervals.

In this invention, a blank area is provided for the drum and the line head is moved by use of the blank area. Therefore, in printing by multi-pass system with the line dot recorder, it is possible to minimize time loss in the movement of the head between the passes, thereby achieving high quality printing efficiently at high speed.

Also, according to this invention, cleaning of a line dot recorder with a plurality of line heads is possible with a relatively simple mechanism.

EXPLANATION OF MARKS

Figure 1:
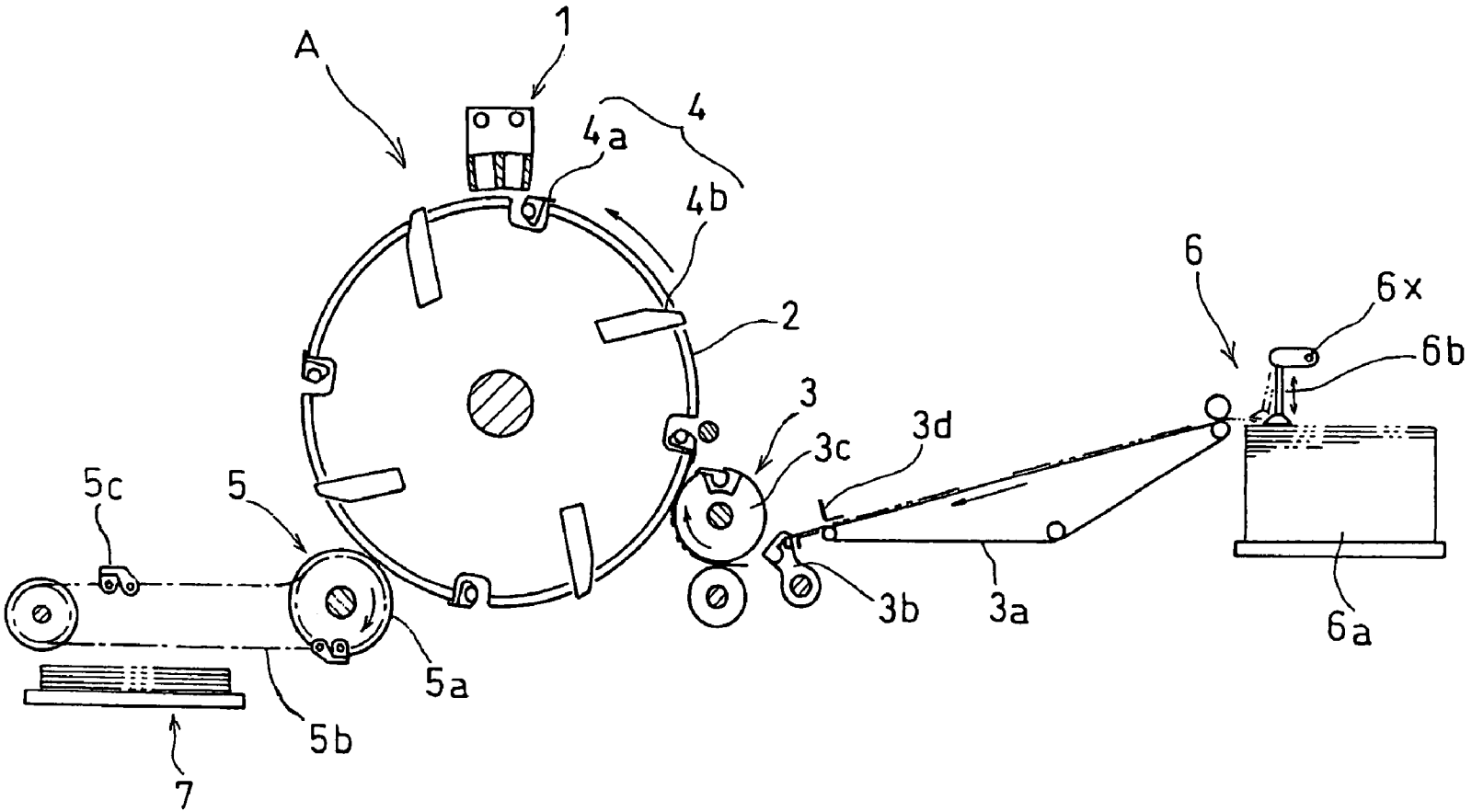
FIG. 1 Schematic view of an embodiment of the dot recorder

1 Nozzle head
2 Rotary drum
3 Paper supply means
3*a* Conveyor
3*b* Pivoting gripper
3*c* Paper feed roller
3*d* Registering means
4 Mounting/holding means
4*a* Gripping claw

4*b* Clamp
5 Paper delivery means
5*a* Paper delivery roller
5*b* Chain
5*c* Gripper claw
6 Suction feed unit
6*a* Storage case
6*b* Suction arm
6*x* Shaft
7 Storage case
10 Carriage
30 Tray
31 Suction unit
35 Mesh plate
1Y Line head
1C Line head
1M Line head
1B Line head
2B Line head
4*a* Fulcrum shaft
BK Blank area
F Wing frame
F Wing frame
L Elevating means
P Paper
P1 First paper
P2 Second paper
P3 Third paper
P4 Fourth paper
SR Rotating surface

DETAILED DESCRIPTION OF PREFERRED EMBODIMENTS

Hereinbelow, embodiments of this invention will be described with reference to the drawings. FIG. 1 is a schematic view showing the line dot recorder embodying this invention. As shown, the line dot recorder A includes a nozzle head 1 having a plurality of inkjet nozzles, and a rotary drum 2 rotatably mounted close to the nozzle head 1.

Further, it includes a paper feed means 3 having a paper feed roller 3*c* for feeding paper as the printing medium from a conveyor 3*a* to the rotary drum 2 through a pivotal grip 3*b*, a mounting/retaining means 4 provided on the rotary drum 2 and having a holding claw 4*a* for mounting the tip of paper on the periphery of the drum 2 and a clamp 4*b* for holding a mid portion of the paper, and a paper delivery means 5 having a paper delivery roller 5*a*, a chain 5*b* and a holding claw 5*c*. 6 is a suction feed unit and 7 is a paper storage case.

Figure 2:
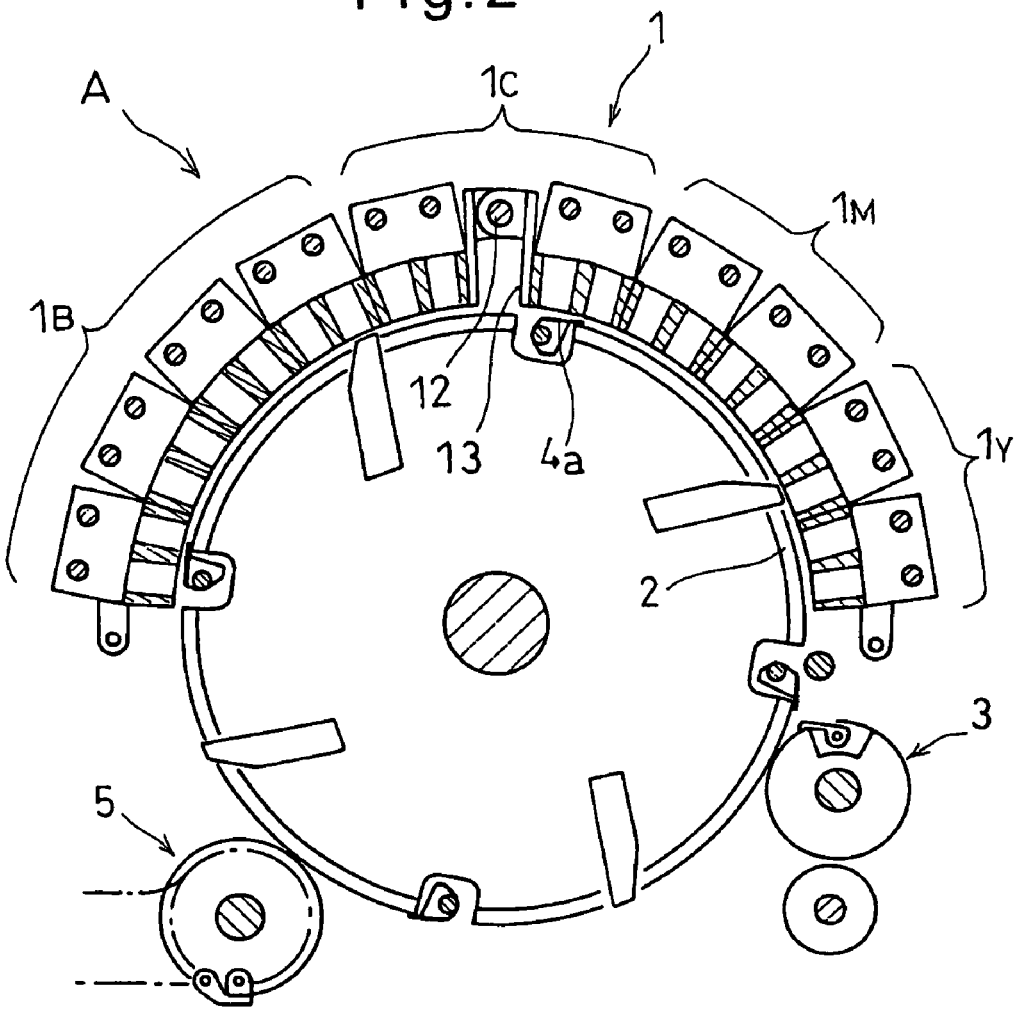
FIG. 2 Sectional view of main portion of the same

Although in FIG. 1 a single nozzle head 1 is shown for simplicity, actually as shown in FIG. 2 a total of ten sets of nozzle heads ($\mathbf{1}_Y$, $\mathbf{1}_M$, $\mathbf{1}_C$, $\mathbf{1}_B$) are provided along about a top half of the circumference of the drum 2. Among them, $\mathbf{1}_Y$, $\mathbf{1}_M$ and $\mathbf{1}_C$ each for one color have two nozzle heads. For black, to insure positive black, four nozzle heads are provided separately. In the embodiment shown, the rotary drum 2 has a sufficient circumference to mount four $A_3$ size paper and four sets of mounting/holding means 4 for holding four papers on the drum surface. The rotary drum 2 is rotated at a predetermined rpm and at a uniform speed by a driving motor (not shown). As for the speed, it will be described below in more detail.

Figure 3:
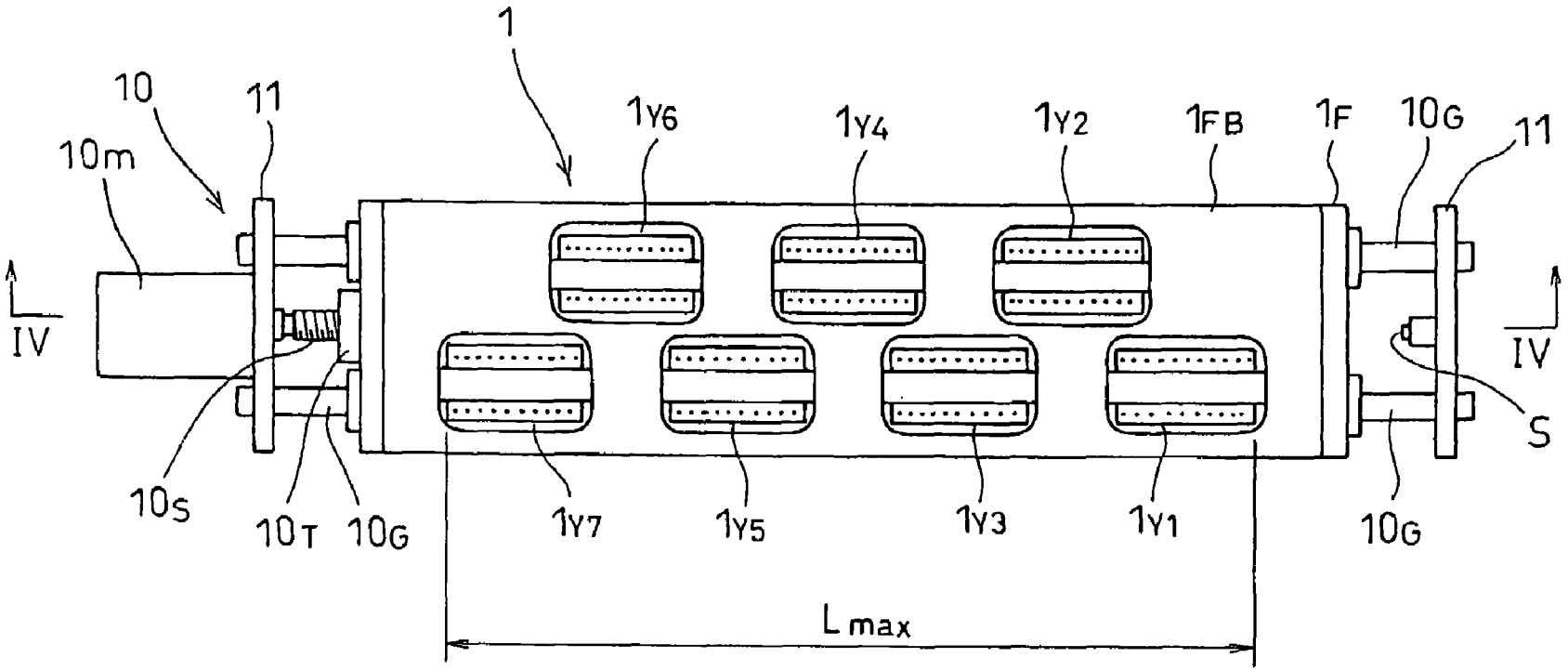
FIG. 3 Bottom view of nozzle head of the same
Figure 4:
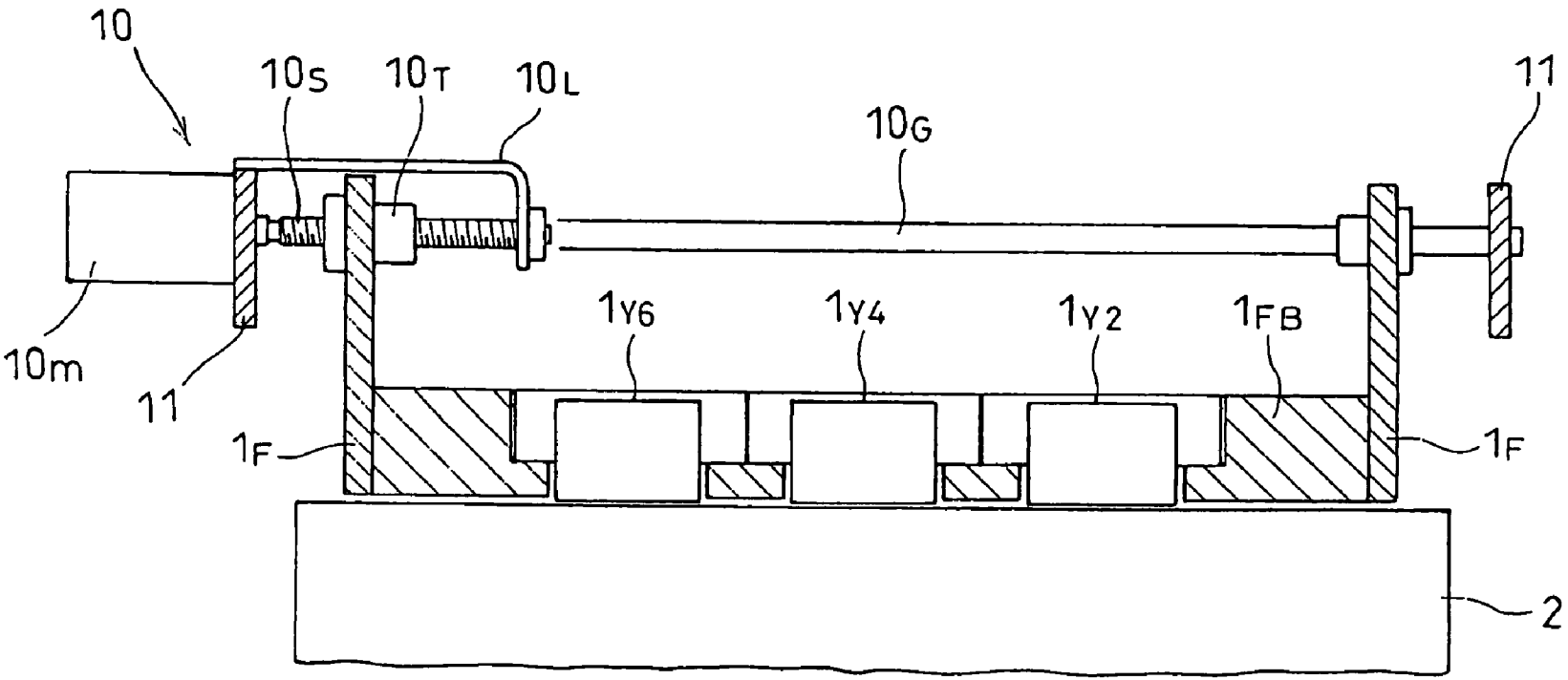
FIG. 4 Sectional view taken along arrow IV-IV of FIG. 3

FIG. 3 is a view showing the bottom of the nozzle head 1 seen from a drum side and FIG. 4 is a sectional view seen from arrow IV-IV of FIG. 3. As shown, the nozzle head 1 has a plurality (7 in the embodiment shown) of pairs of nozzle units $\mathbf{1}_{Y1}$ to $\mathbf{1}_{Y7}$, each consisting of two nozzle units, arranged in staggered fashion and in the first scan direction, that is, width (drum width) direction, on a lower bottom plate $\mathbf{1}_{FB}$ of a support frame $\mathbf{1}_F$ having a U-shaped section as shown in FIG. 4. A head moving means 10 for moving the entire nozzle head 1 widthwise is provided.

Suffix Y denotes head $\mathbf{1}_Y$ among heads of the nozzle head 1 and the suffix of $\mathbf{1}_M$, $\mathbf{1}_C$, $\mathbf{1}_B$ are M, C and B. The first scan direction means the width direction of paper. Ink is jetted simultaneously from every other nozzle (does not mean that ink is jetted from the nozzles in timing delayed little by little) in the first scan direction. Although in this embodiment ink is jetted from every other nozzle, the curtailing manner may be irregular such as two or more, one and two, two and three, etc. or there may be no curtailing.

As shown in FIG. 2, the nozzle heads $\mathbf{1}_Y$, $\mathbf{1}_M$ and $\mathbf{1}_C$ each have a pair of heads. For example, the nozzle head $\mathbf{1}_Y$ has two nozzle units $\mathbf{1}_{Y1}$. One nozzle unit $\mathbf{1}_{Y1}$ has nozzles for a resolution of 150 dpi. Thus the entire nozzle unit $\mathbf{1}_{Y1}$ has a resolution of 300 dpi and two nozzle heads $\mathbf{1}_Y$ have nozzles of a resolution (pixel density) of 600 dpi. This is common for other nozzle units $\mathbf{1}_{Y2}$ to $\mathbf{1}_{Y7}$.

A resolution (pixel density) of 600 dpi is achieved by two heads $\mathbf{1}_{Y1}$, $\mathbf{1}_{Y1}$ in the following manner. When two nozzle units $\mathbf{1}_{Y1}$ are combined back-to-back to form one head $\mathbf{1}_Y$, the recording elements of nozzles are provided at such an interval (about 0.17 mm) that the pitch between the adjacent dots will be 150 dpi. From this state, the pitch between the dots is further shifted by half pitch to 300 dpi, and further the two heads $\mathbf{1}_Y$ are combined so that the pitch between the recording elements will be ¼ pitch (about 40 μm).

The standard period (frequency) (maximum speed in dot recording by jetting from nozzles) of each nozzle unit $\mathbf{1}_{Y1}$ is 9.6 kHz in this embodiment. The standard speed is such that when the rotary drum 2 is rotated at a speed of 11.25 rpm (peripheral speed of drum: 24 meter/min, drum diameter D=70 cm), the dots having a diameter of 40 μm will contact each other in the slow scan direction. The drum is rotated at a speed of four times the standard speed (45 rpm) for dot recording for a resolution of 600 dpi. But four times the standard speed is one example, and the speed is not limited to it. It has only to be more than the standard speed (m times, m is an actual number more than 1) and to be sufficient to achieve an effective increase in the throughput relative to the standard speed. N is not only an integral number but may be an actual number larger than the standard speed such as 1.5 and 3.8.

The drum speed (peripheral speed) has only to be more than the standard speed, but any integral number such as four times speed includes any speed that can be regarded as effectively four times speed such as 3.8. This is common to 2, 3, 5, 6, 7 and other integral number times speeds. In the description below, the embodiment will be described taking four times speed as an example. The nozzle units $\mathbf{1}_{Y1}$ and $\mathbf{1}_{Y7}$ at both ends are provided to adapt to the maximum width (e.g. longer side length of $A_3$ paper) of the paper used, and for smaller paper, the nozzles corresponding to the required width are operated by restricting the feed of the image signals.

The head moving means 10 is coupled to the nozzle head 1 to move each head of the nozzle head 1 ($\mathbf{1}_Y$, $\mathbf{1}_M$, $\mathbf{1}_C$, $\mathbf{1}_B$) in the first scanning direction. A stepping motor 10*m* is fixed to one of the fixed frames 11. A threaded screw $\mathbf{10}_s$ coupled to the output shaft of the stepping motor is mounted through a ball screw coupling $\mathbf{10}_T$ so as to extend through a support frame $\mathbf{1}_F$. By driving the stepping motor 10*m*, the support frame $\mathbf{1}_F$ is moved in the first scanning direction (and in the opposite direction). The other fixed frame 11 can detect the end surface of the support frame $1_F$ to detect the origin of movement of the carriage (head moving means 10).

The head moving means 10 is moved relative to the paper from a plurality (N) of predetermined positions to predetermined positions and stopped. The acceleration and deceleration in moving it are about 0.1 G in this embodiment and the moving distance is max. about 20 mm per once and about 30 mm in total. The operating time for moving in one direction is about 0.3 second and the time from stop to the next start is about 1.3 seconds.

The paper feed means 3 grips one end of the paper fed from the conveyor 3*a* by a pivoting gripper 3*b* and feeds it to the paper feed roller 3*c* where a gripper grips one end of the paper and feeds it to the rotary drum 2. Then a gripping claw 4*a* of the drum 2 clamps the paper.

A suction feed unit 6 provided in front of the conveyor 3*a* of the paper feed means 3 has a suction arm 6*b* which sucks a paper at the top of a storage case 6*a*. The suction arm 6*b* rises by a preset stroke and pivots to hand the paper on to the conveyor 3*a*. The suction arm 6*b* is elevatable and pivotable around a shaft 6*x*. A plurality of suction arms 6*b* are provided in a paper width direction and all the suction arms can rise and pivot all together. The paper fed on to the conveyor 3*a* is registered by a registering means 3*d* provided at one end of the conveyor 3*a* to align in widthwise and vertical directions and is fed to the pivoting gripper 3*b* in preset timing.

The paper delivery means has a gripping claw 5*c* mounted on an endless chain 5*b*. When one end of the paper comes near the paper delivery roller 5*a*, the gripping claw 5*c* will hold the gripping claw 4*a* of the drum to peel the end of the paper off the drum 2 and grip the end of the paper. The paper is fed down by the paper delivery roller 5*a* and piled up in the storage case 7 provided below the two rollers.

Numeral 12 in FIG. 2 is a fulcrum shaft for pivotally supporting a wing frame 13 to which ten nozzle heads 1 are mounted. The wing frame 13 is divided into two portions over the drum 2 and has its both ends adapted to pivot up around the fulcrum shaft 12. The support frame $1_F$ for the nozzle heads 1 has its both ends coupled and fixed to the wing frame 13.

Figure 5A:
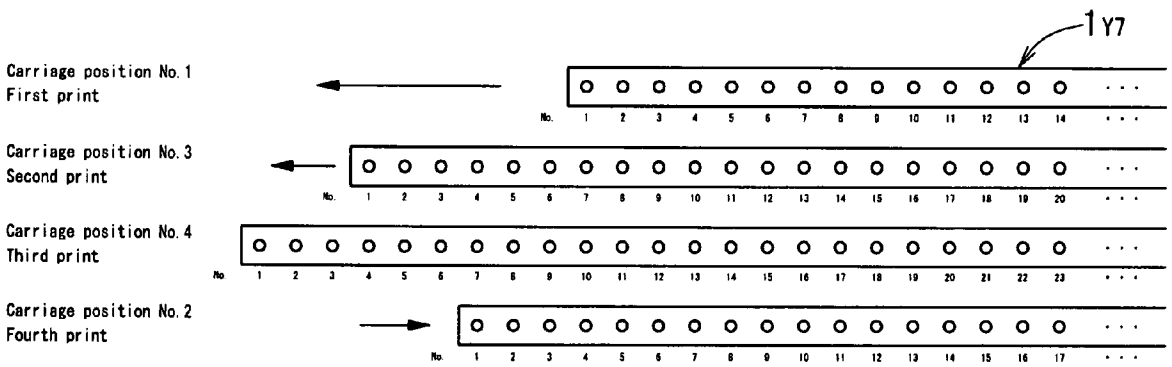
FIG. 5 View showing carriage position of the nozzle head, dot recording position and order to pixels in print area FIG. 6 View showing the relationship between print image and carriage number for each rotation to four papers FIG. 7 View showing the relationship between the drum and the claw number FIG. 8 View showing the timing of paper feed to the drum and how papers are mounted FIG. 9 View showing the relationship between the carriage position, claw No., print, paper supply and paper delivery timings (for base pulse 1 to 18)
Figure 5B:
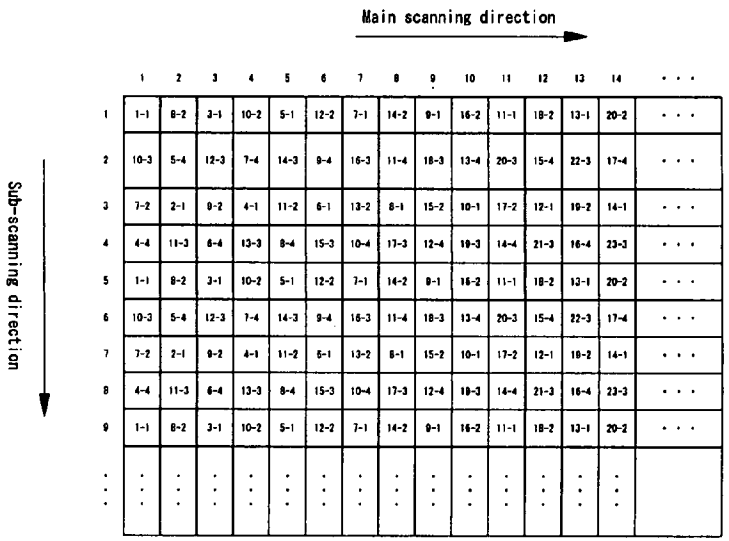

With this embodiment of the line dot recorder, dot recording (printing) is performed in the manner described below. As shown in FIG. 1, a description will be made with reference to a single nozzle head 1 (the nozzle unit is sometimes explained as the nozzle head for convenience). With an actual apparatus A, the operation of one nozzle head 1 is performed by two and/or four sets for each color and their operations are linked one another for color printing. In FIG. 5(*a*), the nozzle head $1_{Y7}$ is used as an example. As shown, one nozzle head $1_{Y7}$ has a plurality of ink nozzles No. 1 to No. 14 provided at the same pitch as the distance between the pixels so as to correspond to the pixel density required for the paper.

In FIG. 5(*b*), numbers 1 to 14 in the first scan direction denote dot recording positions on the paper and the numbers 1 to 9 in the slow scan direction denote dot recording positions on the paper. One square in FIG. 5(*b*) denotes one dot. Thus, the area for dot recording by one nozzle head $1_{Y7}$ extends rightward as addresses No. 1 to No. 14 in the first scan direction in FIG. 5(*b*). As the rotary drum 2 rotates, the paper is fed in a direction opposite to the slow scan direction, so that dot recording is performed in the slow scan direction, too.

At the start of dot recording, it is assumed that the nozzles of the nozzle head $1_{Y7}$ are positioned in the addresses in the first scan direction shown in FIG. 5(*b*) (standard position). The numbers in FIG. 5(*b*) denote the number of the nozzle recording the dot and the dot recording order. For example, 1-1 means that dot recording of the address is done by the first dot recording by No. 1 nozzle. 1-2 means the second dot recording by No. 1 nozzle. 2-1 means the first dot recording by No. 2 nozzle. 2-2 means the second dot recording by No. 2 nozzle (not shown).

At the start of dot recording, the nozzle head $1_{Y7}$ is placed at the carriage position No. 1 shown at top of FIG. 5(*a*). In response to the start signals, the nozzles No. 1, 3, 5, 7, . . . (odd number line) jet ink at one time for dot recording of pixels No. 1-1, 3-1, 5-1, . . . . As the drum 2 rotates, the nozzle head $1_{Y7}$ relatively advances in the slow scan direction. When it reaches the address No. 5 in the slow scan direction, the nozzles of odd number again jet ink for dot recording.

Further, dot recording in the first scan direction is done in the same manner at the address No. 9, 13, 17, . . . in the slow scan direction one after another for multi-pass dot recording every four dots in the slow scan direction. This completes multi-pass dot recording by the first rotation on the entire printing area in the slow scan direction on one paper. Next, before the start of multi-pass dot recording by the second rotation, the nozzle head $1_{Y7}$ is moved to the carriage position No. 3 by six dots in a direction opposite to the first scan direction as shown in FIG. 5(*a*).

As for the carriage position No., the position of the nozzle head $1_{Y7}$ at start of dot recording is the basic position, that is, No. 1 position. The carriage position is numbered according to the distance from the basic position. Because the nozzle head is moved by six dots for the second dot recording, the carriage position for the second recording is No. 3. In dot recording by the second rotation, as shown in FIG. 5(*b*), the nozzles No. 8, 10, 12, 14, . . . (even number) jet ink for dot recording to pixels No. 2, 4, 6, 8, . . . in the No. 1 line in the slow scan direction.

When the nozzle head $1_{Y7}$ advances relatively in the slow scan direction to line No. 3, the nozzles No. 7, 9, 11, 13, . . . jet ink for dot recording to pixels No. 1, 3, 5, 7, . . . . When the nozzle head $1_{Y7}$ further advances in the slow scan direction, dot recording is done similarly for lines No. 7, 11, . . . . Next, before dot recording by the third rotation is started, the nozzle head $1_{Y7}$ is moved by 3 dots in a direction opposite to the first scan direction to the carriage position No. 4.

When one paper starts the third rotation, the nozzles of an odd number, that is, No. 10, 12, 14, 16, . . . jet ink for dot recording to pixels No. 1, 3, 5, 7, . . . in the No. 2 line in the slow scan direction. When the nozzle head $1_{Y7}$ further advances, the nozzles of an even number, that is, No. 11, 13, 15, . . . jet ink for dot recording to pixels No. 2, 4, 6, 8, . . . in the No. 4 line. When the nozzle head advances further, the nozzles of an odd number jet ink in the line No. 6, and the nozzles of an even number jet ink in the line No. 8. As such, in the lines of an odd number, the nozzles of an odd number and those of an even number jet ink alternately for dot recording every one dot.

Before shifting to dot recording by the fourth rotation of the drum, the nozzle head $1_{Y7}$ is moved back in the first scan direction by 6 dots to the carriage position No. 2. In the fourth rotation of the drum, in the line No. 2 in the slow scan direction the nozzles of an even number, that is, No. 5, 7, 9, 11, . . . jet ink for dot recording to pixels No. 2, 4, 6, 8, . . . that is, (5-4), (7-4), (9-4), . . . .

When the nozzle head $1_{Y7}$ advances further, in the line No. 4 the nozzles of an odd number, that is, nozzles No. 4, 6, 8, 10, . . . jet ink for dot recording to pixels No. 1, 3, 5, 7, . . . for (4-4), (6-4), (8-4). In the line No. 6, the nozzles of an even number, that is, No. 5, 7, 9, 11, . . . jet ink to pixels No. 2, 4, 6, 8, . . . that is, (5-4), (7-4), (9-4).

In moving the nozzle head $1_{Y7}$ in the first scan direction and the opposite direction among N positions (N=4) including the basic position, they are moved and stopped to such a position that in the maximum moving distance in the first scan direction (9 dots in the embodiment), the distance between the adjacent two positions (e.g. between carriage positions No. 1 and No. 2 and between No. 2 and No. 3) will be uniform (3 dots in the embodiment). The nozzle head moving means is coupled to the nozzle head so that the nozzle head can be moved for such a distance that a predetermined number of print images (image 1, 2, 3, 4) can be formed. In this embodiment, the distance between the adjacent two carriage positions is 3 dots. But this is a mere example. The distance is not limited. The greater the number of the nozzles on one nozzle head, the greater the distance may be, such as 5, 10, 100 dots.

When the nozzle head $\mathbf{1}_{Y7}$ moves leftward from the carriage position No. 1 in FIG. 5(*a*), some nozzles get out of the regular dot recording range. For example, they are the nozzles No. 1 to No. 6 in the carriage position No. 3 in FIG. 5(*a*). They do not jet ink in dot recording by the second rotation. The nozzles No. 1 to No. 9 in the carriage position No. 4 and the nozzles No. 1 to No. 3 in the carriage position No. 2 do not jet ink, either. The above-mentioned operation is repeated by the nozzle heads $\mathbf{1}_{Y7}$ to $\mathbf{1}_{Y1}$ and by two nozzle head units to complete dot recording for one color on the recording area on one paper. A similar operation is repeated for other colors for color printing.

As described above, while the carriage position No. moves 1→3→4→2, the acceleration and deceleration are 0.1 G, the maximum moving distance is about 30 mm, operating time in one direction is about 0.3 second, and time from stop to re-start is about 1.3 second.

Such a manner of moving and stopping is achieved by adopting a line head printer type and a recording head which moves and stops for an extremely small distance at small acceleration and deceleration with a short operating time in contrast to a conventional serial printer (e.g. see Patent publication 3) in which a carriage moves for the entire width distance at high speed and rapid acceleration and deceleration.

The moving distance, acceleration and deceleration and the operation time are set to adapt to the printing conditions with a rotary drum, on four papers, dot recording by four rotations, four times speed and multi-pass (4 pass). If the moving distance, acceleration and deceleration and operation time are set for N sheets (N=not 4), N rotation, speed higher than the basic speed, and N pass, they are set to optimal values according to the number of N.

Figure 6:
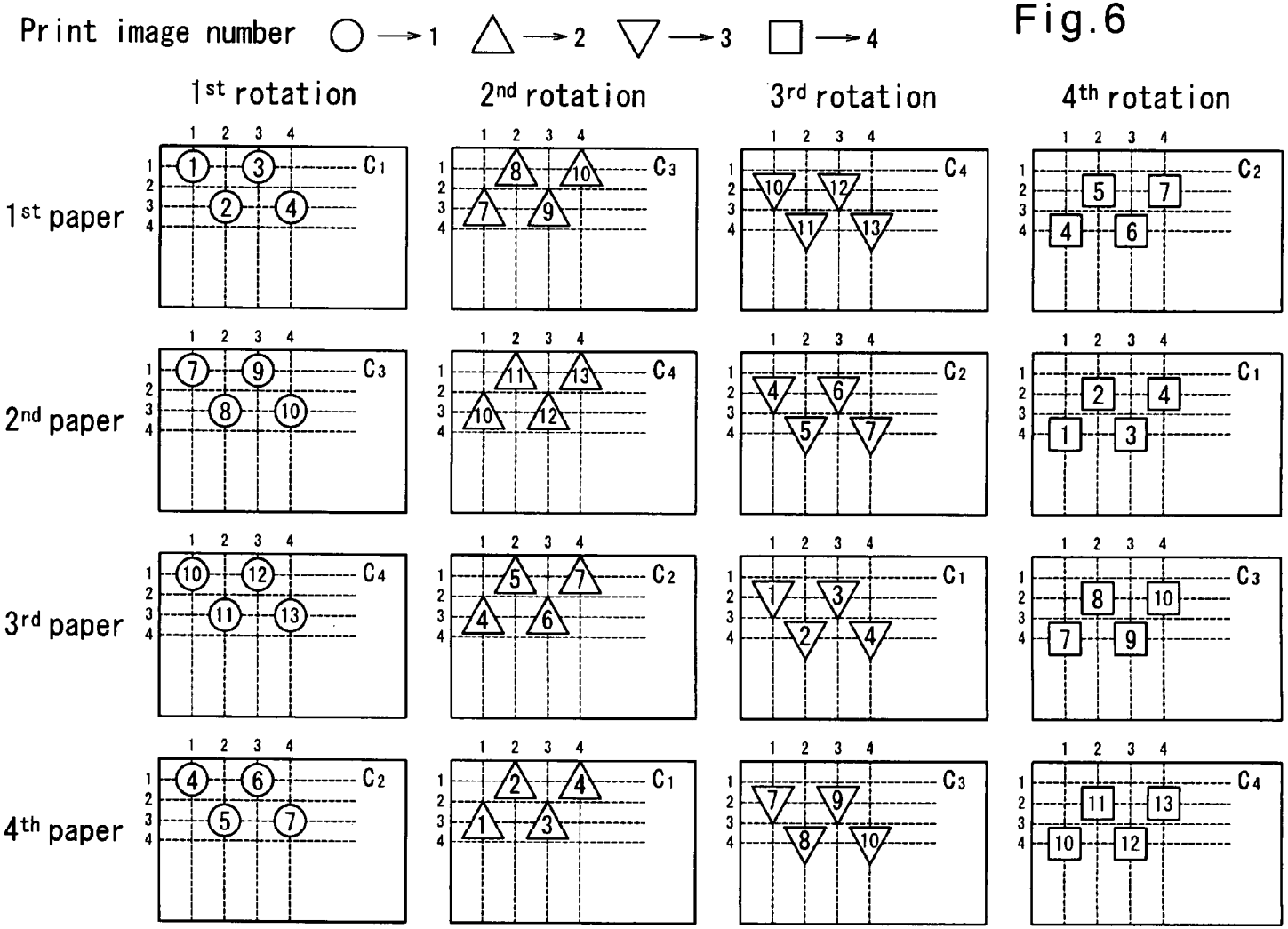

The above is the function for dot recording on the first paper with reference to FIG. 5. FIG. 5 shows the results of repeated dot recording by four rotations to all the pixels whereas FIG. 6 shows the relationship between the nozzle used for dot recording of each pixel and the pixel for each rotation. In FIG. 6, in the first rotation, ○1 denotes (1-1), ○2 denotes (2-1), ○3 denotes (3-1), and ○4 denotes (4-1). In the second rotation, Δ7 denotes (7-2), Δ8 denotes (8-2), Δ9 denotes (9-2) and Δ10 denotes (10-2). In the third rotation, ∇10 denotes (10-3), ∇11 denotes (11-3), ∇12 denotes (12-3) and ∇13 denotes (13-3). In the fourth rotation, □4 denotes (4-4), □5 denotes (5-4), □6 denotes (6-4) and □7 denotes (7-4).

In FIG. 6, $C_1$, $C_3$, $C_4$, $C_2$ show the carriage position. As seen from the figure, for the first paper, the carriage position changes $C_1 \rightarrow C_3 \rightarrow C_4 \rightarrow C_2$. FIG. 6 shows that dot recording for the second paper is done in the same image order as for the first paper. As shown, the nozzles of different numbers are used for the same pixel position. For example, for print image No. 1 for the first paper for the first rotation, nozzles No. 1, 3, . . . operate for the first line, and nozzles No. 2, 4, . . . operate for the third line. For print image No. 2, nozzles No. 8, 10, . . . operate for the first line, and nozzles No. 7, 9, . . . operate for the third line. For print images No. 3 and 4, too, dot recording is done in the same manner.

For the second paper for the first rotation for print image No. 1, nozzles No. 7, 9, . . . operate for the first line, and nozzles No. 8, 10, . . . operate for the third line. For print image No. 2, nozzles No. 11, 13, . . . operate for the first line, and nozzles No. 10, 12, . . . operate for the third line. For the print images No. 3 and 4, too, dot recording is done in the same manner. Thus, the print image number is the same (print image 1) for the first paper and the second paper for the first rotation, but nozzles of different number are used. This is the case for the third and fourth papers, too.

But, for the second paper, the carriage position is $C_3$ for the first rotation, $C_4$ for the second rotation, $C_2$ for the third rotation and $C_1$ for the fourth rotation. For the third paper, the carriage position changes $C_4 \rightarrow C_2 \rightarrow C_1 \rightarrow C_3$. For the fourth paper, it changes $C_2 \rightarrow C_1 \rightarrow C_3 \rightarrow C_4$. For the second paper and after, the carriage position starts from the position one position shifted from the first position for the first paper, but changes in the same order as for the first paper. The above description is only for one color, and actually the nozzle heads for different colors do the same action in timing shifted little by little, so that color overlapping manner and color tone will be uniform for all papers.

Described above is dot printing on four papers with all papers mounted on the drum beforehand by multi-pass (4-pass) system by four rotations. Actually printing on the first paper has ended before the printing by the fourth rotation starts on the second paper and after. Large-volume continuous printing is possible by delivering the printed paper and supplying the next paper to the now vacant position. Mass printing will be described below in which paper is supplied continuously for continuous printing.

Figure 7:
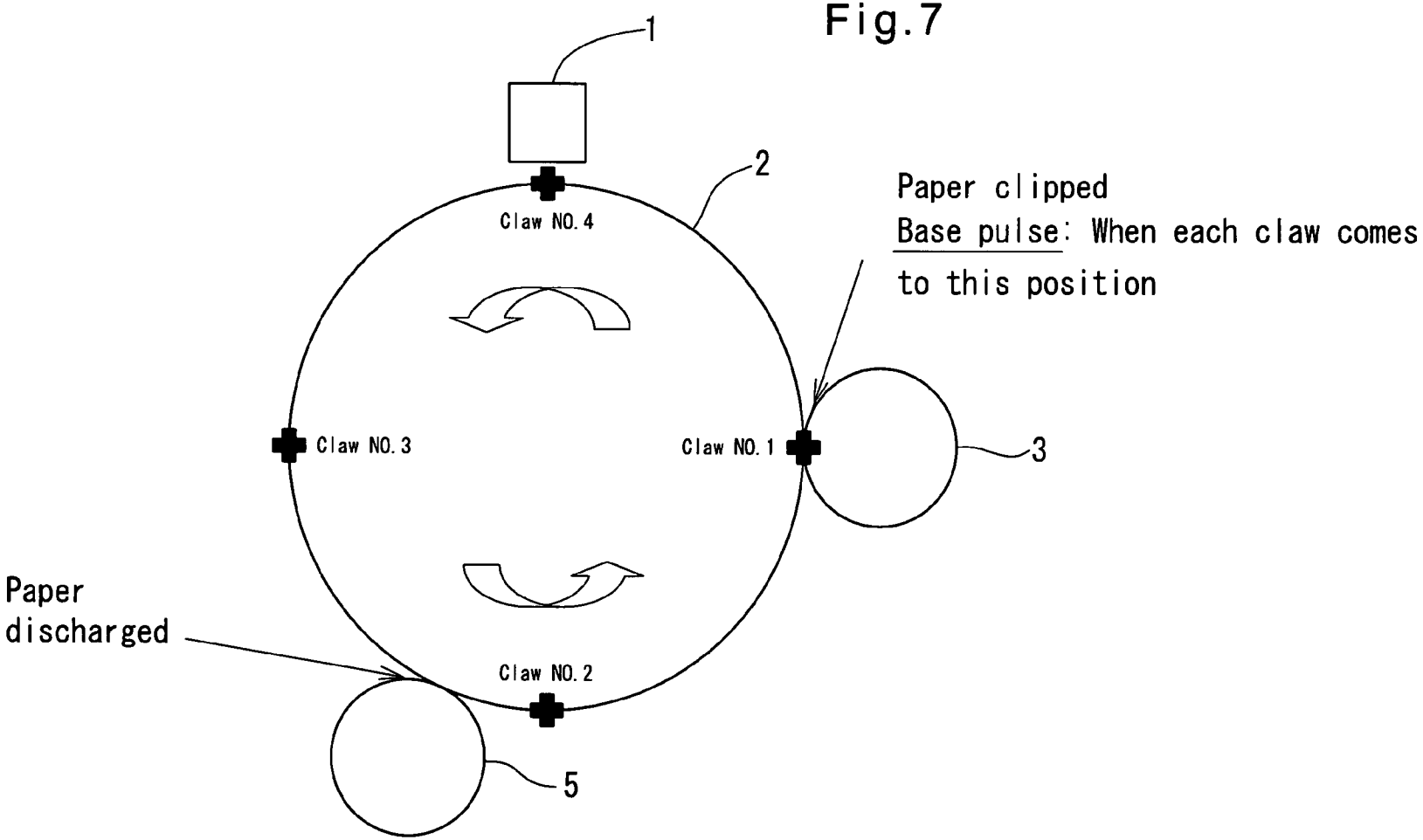
Figure 8:
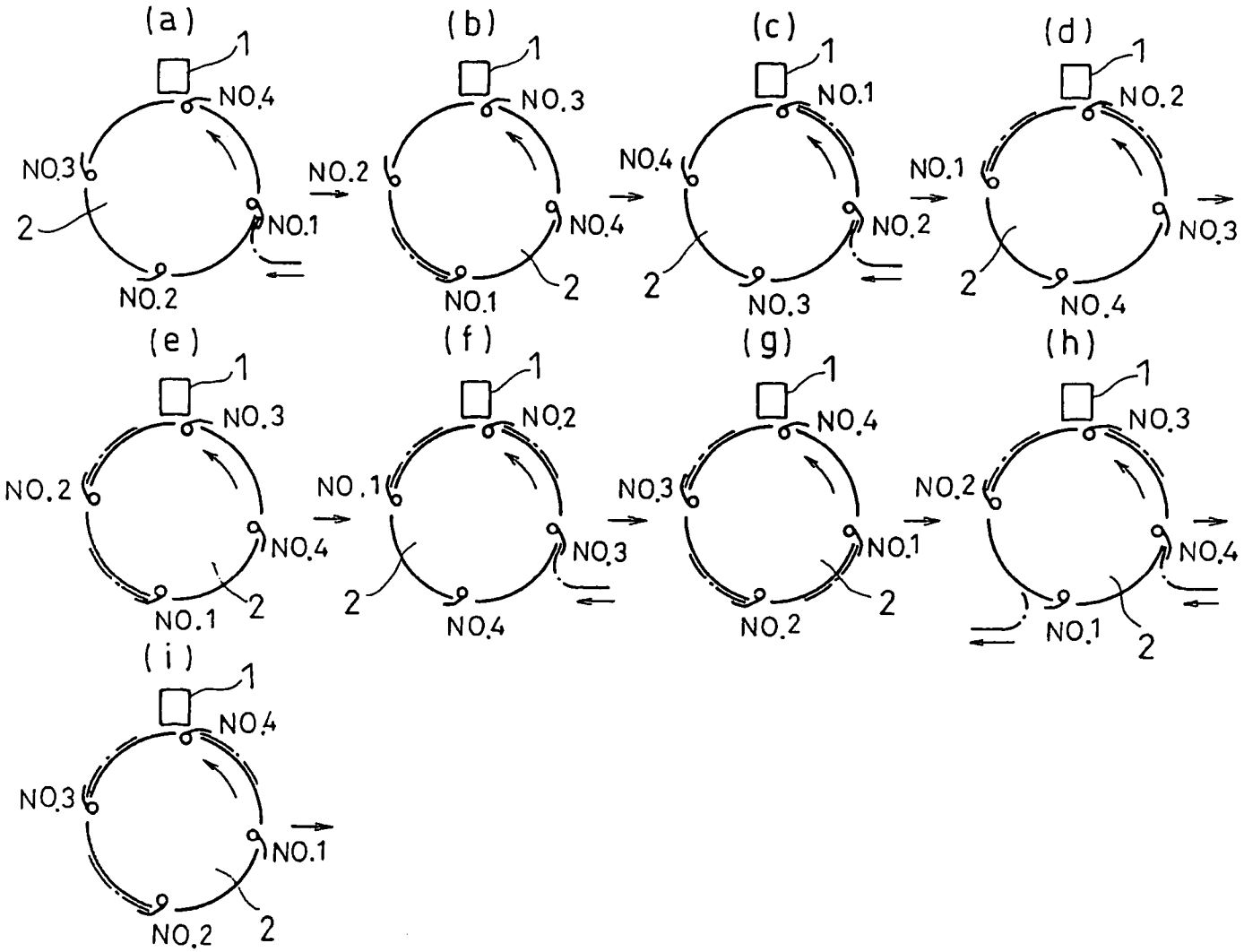

The rotary drum 2 has four gripping claws 4*a* so that four papers can be mounted on the drum at equal distances (but four not always mounted). As shown in FIGS. 1 and 7, claw No. 1 is provided at the paper supply position where paper is fed from the paper supply means 3. Claws No. 2, 3 and 4 follow in this order in the drum rotating direction (counter clockwise direction). When paper comes between claws No. 3 and No. 2, it is delivered by paper delivery means 5. FIG. 8 is a view showing how paper is supplied to the drum as the drum rotates. The phase changes from (a) to (i) and four papers are gripped by four claws No. 1 to No. 4 one after another.

Because the explanation becomes complicated if a plurality of nozzle heads shown in FIG. 2 are described, a single nozzle head 1 is shown in FIG. 8 at top of the drum 2 on the center line. Also, FIGS. 9 and 10 show the relationship between the paper supply and the print order and the paper delivery in correspondence to FIG. 8.

Figure 9:
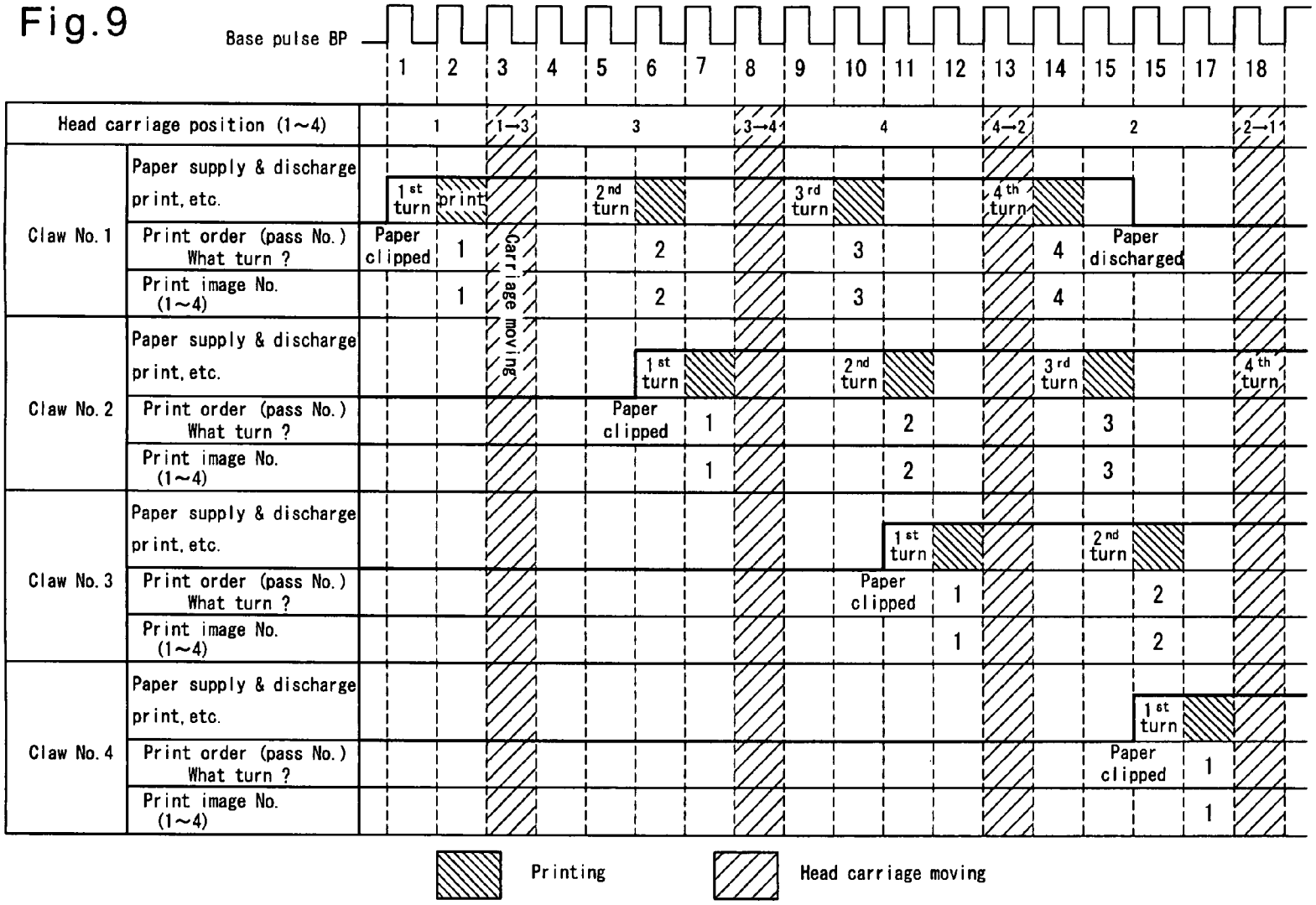
Figure 10:
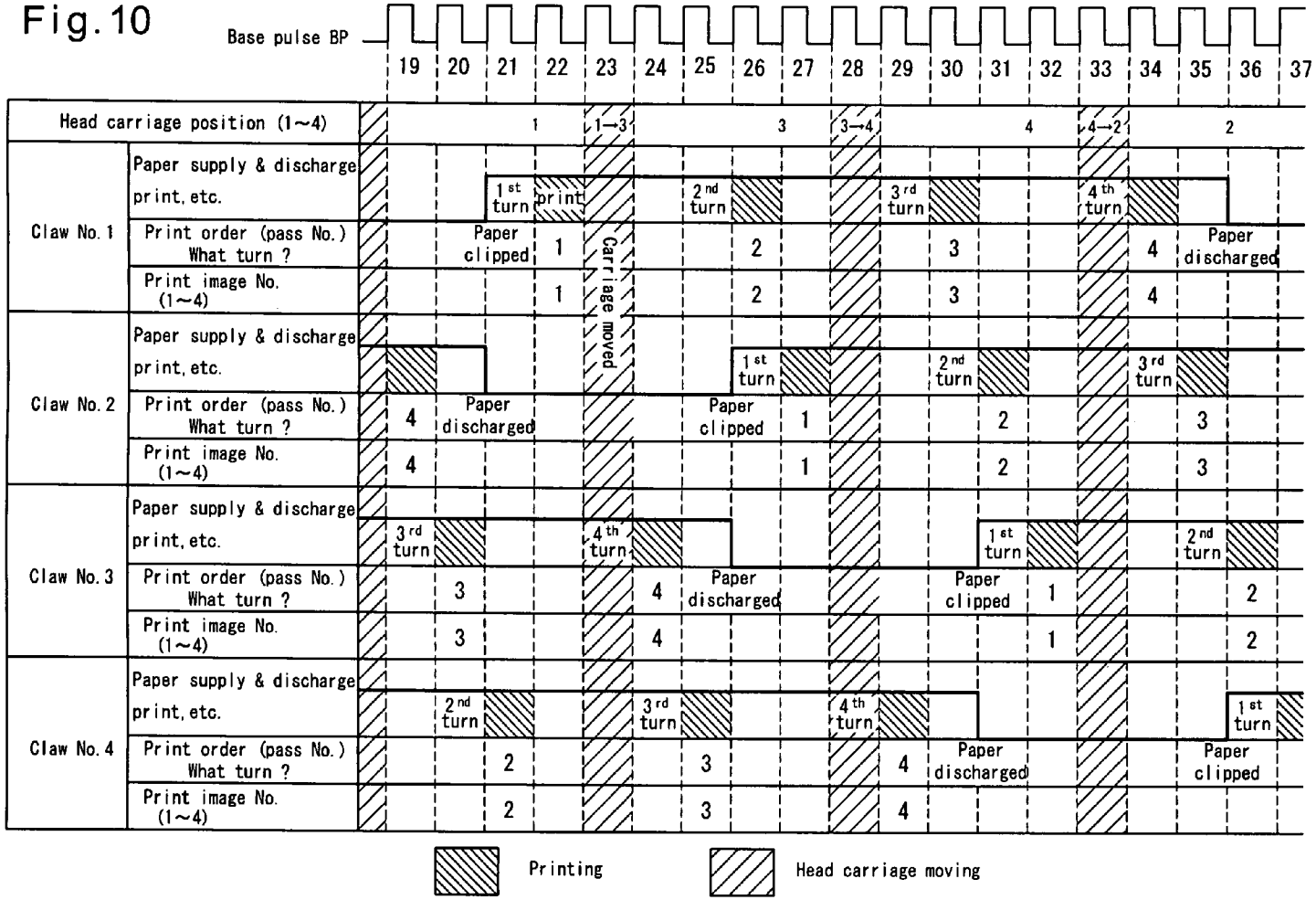
FIG. 10 View showing the relationship between the carriage position, claw No., print, paper supply and paper delivery timings (for base pulse 19 to 36)

FIGS. 9 and 10 show how the paper supply, print and paper delivery change in response to base pulses BP as the basic timing signals as para-time charts. The base pulses BP are shown with one pulse for ¼ rotation of the drum. When the claw No. 1 is at right side of the drum, base pulse 1 is given, and each time the drum turns ¼ rotation, increments one by one.

FIG. 8(*a*) shows the state at the start of paper supply. When the first paper comes from the paper feed means 3 at a preset timing, it is gripped by claw No. 1, mounted on the drum and fed as the drum 2 rotates. In response to base pulse BP 2, the first paper passes under the nozzle head 1, so that printing is started. With the abovementioned dot recording method, dot recording is done on a predetermined area on the first paper.

When print by the first rotation of the drum on the first paper ends, base pulse BP 3 is given. As the second paper has not yet been mounted, the carriage position is moved.

This is because the carriage has to be moved to position No. 3 for the second dot recording on the first paper as described above. The carriage position has to be changed at timing when there is no paper under the nozzle head 1. FIG. 8(*b*) shows the state of drum where the nozzle head 1 is moved to carriage position No. 3. The drum 2 continues rotation and makes one full turn at base pulse 4. When the drum 2 makes ¼ turn at base pulse 5, as shown in FIG. 8(*c*), claw No. 1 reaches under the nozzle head 1 and the second paper is supplied from the paper supply means 3 and claw No. 2 clamps the end of the second paper.

The drum 2 makes a further ¼ turn by base pulse 6. While the phase shifts from (c) to (d) in FIG. 8, the second dot recording is done on the first paper. Then the second paper clamped by the claw No. 2 reaches just before the nozzle head 1. While the drum 2 makes ¼ turn by base pulse 7, the first dot recording is done on the second paper. The phase proceeds to (e).

When the drum 2 makes ¼ turn from state (e) by base pulse 8, the carriage position changes from No. 3 to No. 4 because the third paper has not yet been clamped by the claw No. 3. With this ¼ turn, the drum passes the base position of the claw No. 1 and starts its third rotation. The drum makes ¼ turn by base pulse 9. While it makes another ¼ turn by base pulse 10, dot recording by the third rotation is done on the first paper. The second paper starts the second rotation.

In FIG. 8, (*f*) shows the state where dot recording on the first paper by the third rotation ends by base pulse 10 and the second paper is about to start its second rotation. As shown, at this timing the third paper is supplied from the paper supply means 3 and its end is clamped by the claw No. 3. By base pulse 11, dot recording by the second rotation is done on the second paper. The third paper advances by ¼ turn to just before the nozzle head 1. While the drum advances ¼ turn by base pulse 12, dot recording by the first rotation is done on the third paper. (g) shows the state when dot recording has ended.

During ¼ turn by base pulse 13, no dot recording is needed on any of the papers clamped by claws No. 1 to No. 3. Also, the fourth paper has not yet been clamped by claw No. 4. So at this timing the nozzle head 1 changes its carriage position from No. 4 to No. 2. The first paper starts the fourth rotation by base pulse 13. By base pulse 14 the fourth dot recording is done on the first paper and the second paper starts the third rotation. By base pulse 15 the third dot recording is done on the second paper and the third paper starts the second rotation.

By base pulse 16, the first paper is delivered, dot recording by the second rotation is done on the third paper, and the fourth paper is clamped by the claw No. 4. The state at start of the action by the base pulse 16 is shown at (h) of FIG. 8, and the state at end of the action by the base pulse 16 is shown at (i) of FIG. 8. After dot recording has been done by base pulse 17 on the fourth paper, the nozzle head is moved. Therefore, at the timing of (i), paper is not supplied to claw No. 1 within a period from base pulse 16 for paper delivery to 5 pulses ahead (1+¼ turn).

At base pulse 17, printing by the first rotation is done on the fourth paper. At next base pulse 18, the nozzle head 1 is moved to change the carriage position from No. 2 to No. 1. By base pulse 19, printing by the fourth rotation is done on the second paper. By base pulse 20, printing by the third rotation is done on the third paper. Now the drum returns to the base position where the first paper is clamped by claw No. 1, and next base pulse 21 re-starts paper supply. This cycle is repeated.

The relationship between the carriage position for four papers, the number of times of printing, and the print image formed by this cycle is as follows:

TABLE 1

| | Print | | | |
|---|---|---|---|---|
| Paper | First Rotation | Second Rotation | Third Rotation | Fourth Rotation |
| First | $C_1/I_{m1}$ | $C_3/I_{m2}$ | $C_4/I_{m3}$ | $C_2/I_{m4}$ |
| Second | $C_3/I_{m1}$ | $C_4/I_{m2}$ | $C_2/I_{m3}$ | $C_1/I_{m4}$ |
| Third | $C_4/I_{m1}$ | $C_2/I_{m2}$ | $C_1/I_{m3}$ | $C_3/I_{m4}$ |
| Fourth | $C_2/I_{m1}$ | $C_1/I_{m2}$ | $C_3/I_{m3}$ | $C_4/I_{m4}$ |
| Fifth | $C_1/I_{m1}$ | $C_3/I_{m2}$ | $C_4/I_{m3}$ | $C_2/I_{m4}$ |
| Sixth | $C_3/I_{m1}$ | $C_4/I_{m2}$ | $C_2/I_{m3}$ | $C_1/I_{m4}$ |
| . | . | . | . | . |
| . | . | . | . | . |
| . | . | . | . | . |

$C_1$ to $C_4$ denote the carriage position number, and $I_{m1}$ to $I_{m4}$ denote the print image number. The print image means the entire image formed by the dot patterns recorded by each rotation e.g. on the first paper shown in FIG. 6. For each rotation, a different number is given.

Figure 11:
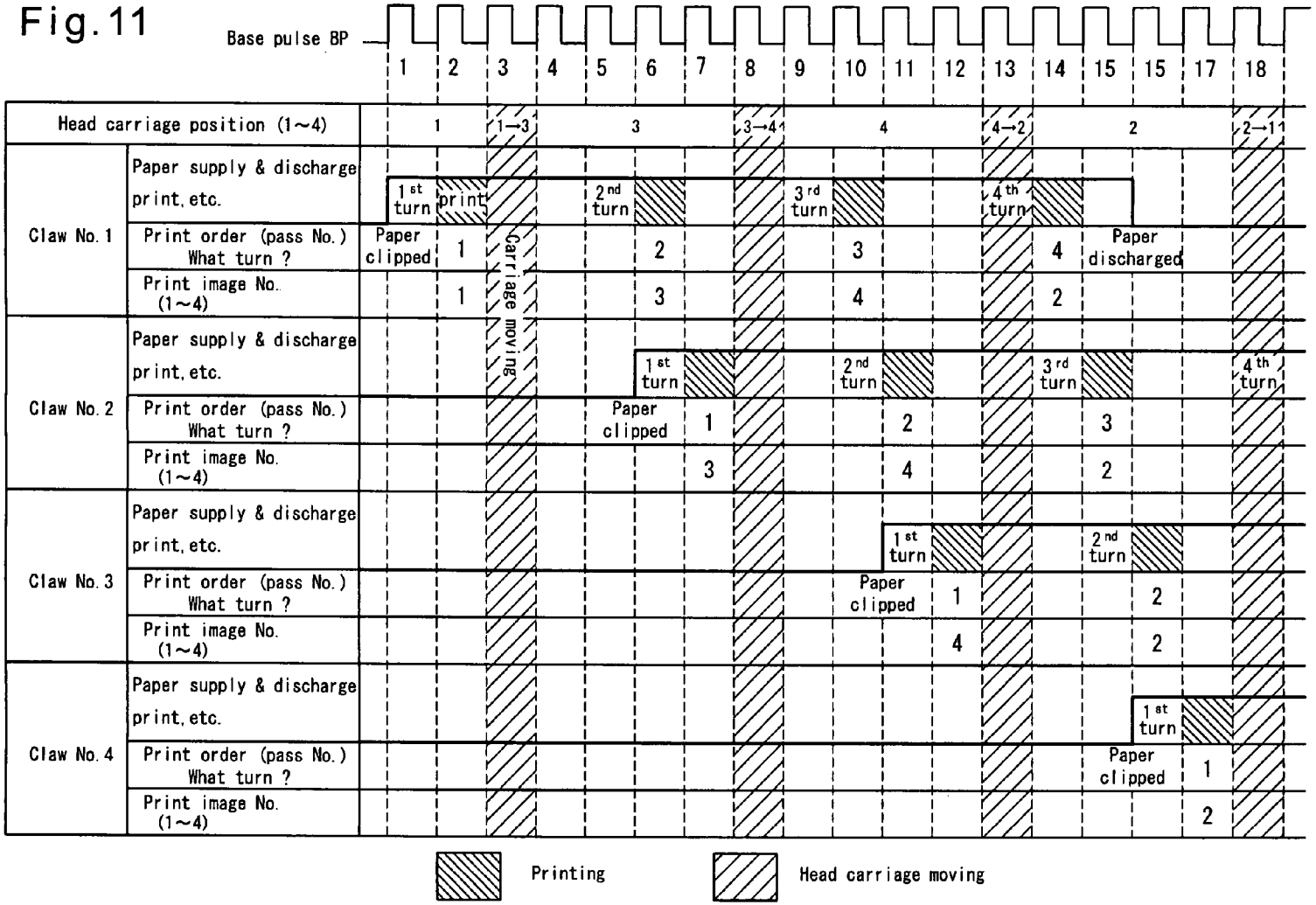
FIG. 11 View showing the relationship between the carriage position, claw No., print, paper supply and paper delivery timings (for base pulse 1 to 18)
Figure 12:
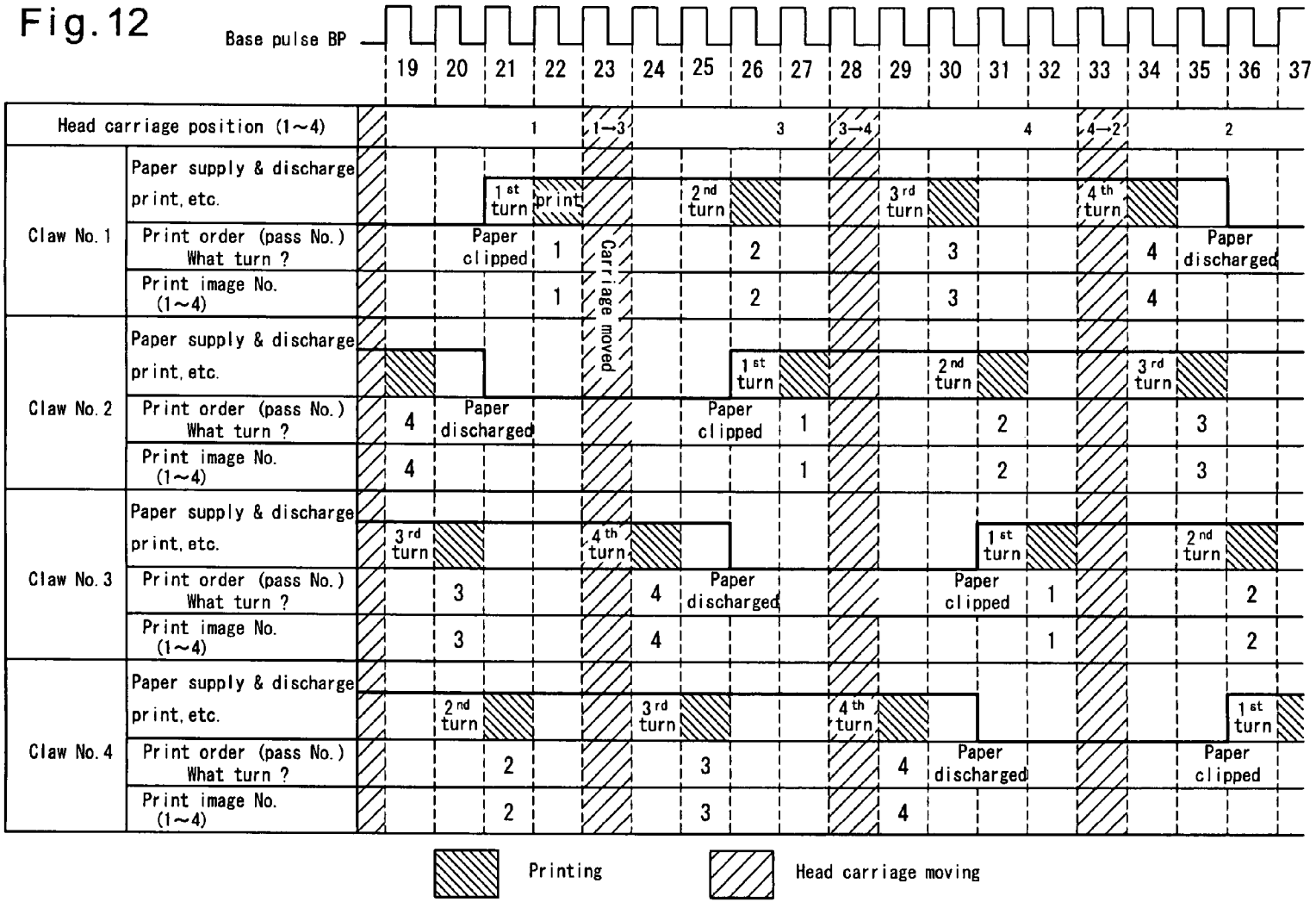
FIG. 12 View showing the relationship between the carriage position, claw No., print, paper supply and paper delivery timings (for base pulse 19 to 36)

FIGS. 11 and 12 show another example of the cycle. In this example, the carriage position number when printing is the same as the print image number at that time. In this case, the order of print image when printing on four papers differs with paper, but the same nozzles on the nozzle head are used for the same print image. The relationship between the image numbers for four papers and the nozzles used are shown in FIG. 12.

Figure 13:
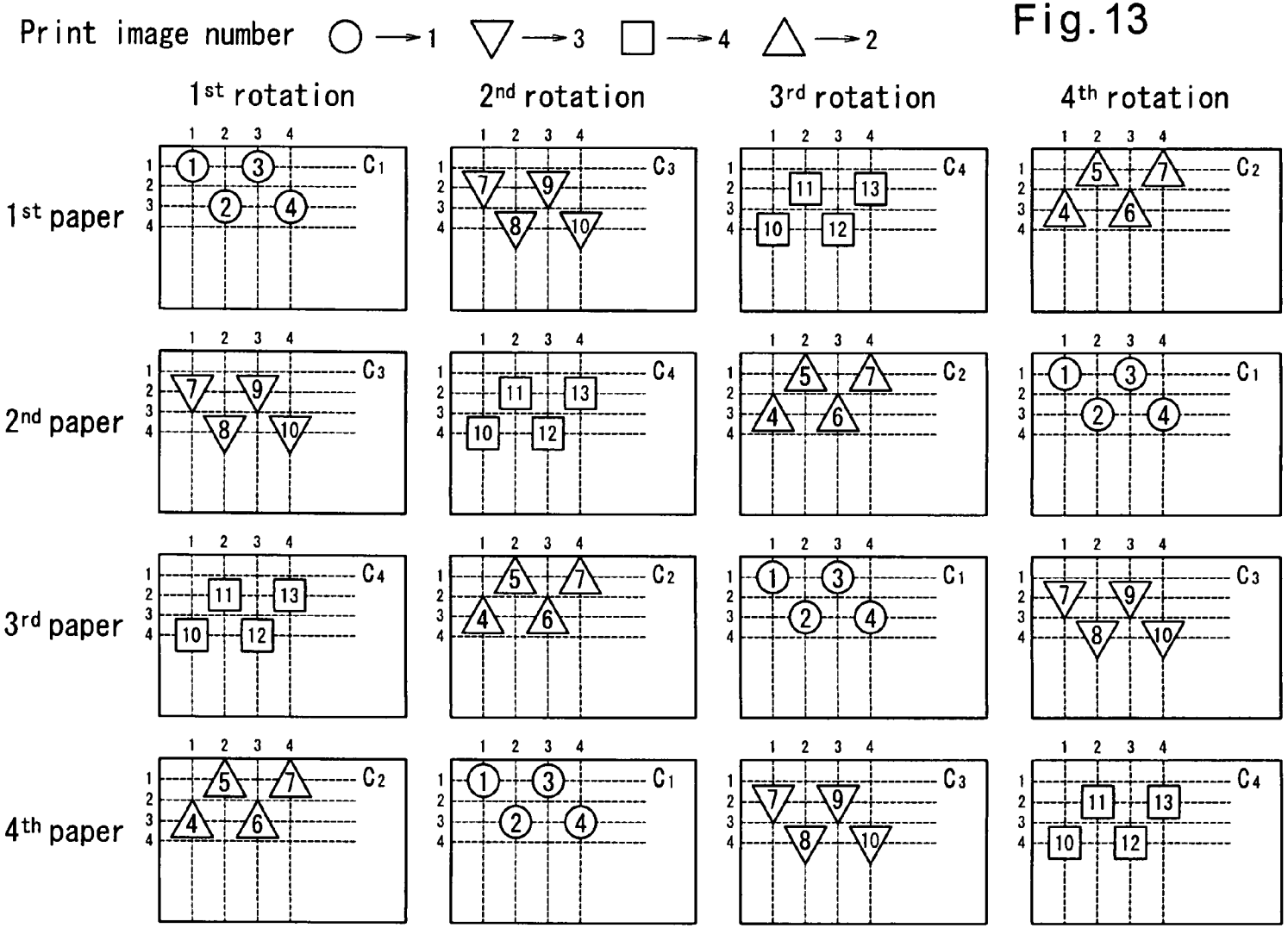
FIG. 13 View showing the relationship between the print image and the carriage number in other example FIG. 14 View showing the entire third embodiment FIG. 15 Front view of a part of the third embodiment FIG. 16 View explaining the operation of third embodiment FIG. 17 View explaining the operation of third embodiment FIG. 18 View explaining the operation of third embodiment FIG. 19 View explaining the operation of third embodiment FIG. 20 View explaining the operation of third embodiment FIG. 21 View explaining the operation of third embodiment FIG. 22 View explaining the operation of third embodiment FIG. 23 View explaining the operation of third embodiment FIG. 24 View explaining the operation of third embodiment FIG. 25 Front view of a portion of the fourth embodiment FIG. 26 Side view of a portion of the fourth embodiment FIG. 27 Side view of a portion of the fourth embodiment FIG. 28 Front view of a portion of the fourth embodiment FIG. 29 View explaining the operation of the fourth embodiment FIG. 30 Block diagram of the fourth embodiment FIG. 31 View explaining the operation of the fourth embodiment FIG. 32 View explaining the operation of the fourth embodiment FIG. 33 View explaining the operation of a conventional structure

As seen from FIG. 13, for example, the image formed by dot recording on the first paper by second rotation by nozzles Nos. 7 and 9 on the pixel positions (2-1) (second line-first row) and (2-3), and by nozzles Nos. 8 and 10 on the pixel positions (4-2) and (4-4) corresponds to the image number 3 in FIG. 6. Similarly, by the third rotation, image number 4 is formed by dot recording by nozzles Nos. 11, 13, 10, 12 on the pixel positions (2-2), (2-4), (4-1), (4-3). Also, image number 2 is formed by dot recording by nozzles Nos. 5, 7, 4, 6 on the pixel positions (1-2), (1-4), (3-1), (3-3).

On the second paper, image number 3 is dot recorded by the first rotation, not by the second rotation as for the first paper. The carriage number is the same as the image number. On the third paper, dot recording is done with the carriage number shifted by one from the second paper. From above, it is seen that in this example, the same nozzles are used to print one given print image.

This means that even if the same nozzles are used for one color when printing one paper after another, uniform print quality can be insured. Because all the papers are printed by the same cycle while shifting timing little by little for each color, change in color thickness or dot position with nozzles can be eliminated by using the same nozzles. The print quality can be kept uniform by making the color shade uniform among papers.

In the embodiment, as for the print medium, N(N=4) sheets of paper of maximum size ($A_3$) can be mounted on the drum. But the print medium may be a long sheet paper of a length equal to the total length of N sheets. In this case, an image of a size N times the image to be formed on the paper of maximum size may be formed on such a long sheet and it may be cut to N sheets to obtain a uniform image on the individual sheets. Also, a long image may be printed on such a long paper and it may be used as it is without cutting after printing.

In the embodiment, 4-sheet mounting drum, 4-pass system, 4-rotation, 4-times speed are adopted for printing. The figure is not limited to four. It may be an integer that is two or more except for the rotation speed. Namely, N may be 2, 3, 4, 5, 6, 7, . . . . But, actually the figure N and the diameter of the rotary drum are limited to practically possible ranges.

In the embodiment, as for the drum speed, the number of times N=4. As mentioned above, N may be 2, 3, 4, 5, 6, 7, . . . . But, for the drum speed, N may be not only an integer but also a real number more than the standard speed. For example, it may be a real number greatly different from 4 such as 1.5 times the standard speed, so long as it results in an increase in the throughput (shorter time) relative to the case where the drum is rotated at the standard speed.

Although in the embodiment the rotary drum 2 is rotated at a higher speed than the standard speed for mass printing, the dot recorder according to this invention may have the drum 2 rotated at a lower speed than the standard speed. Such a line dot recorder will be described below as the second embodiment with dot recording conditions such as N sheets of paper, N multi-pass and N-rotation, paper supply means 3 for continuous printing at regular intervals, paper mounting/holding means 4 and paper delivery means 5. But, since the appearance is the same, it is not shown.

With this embodiment, since the rotary drum 2 is rotated at a lower speed than the standard speed, the period speed, that is, the ink jetting timing from the nozzles of the nozzle head 1, too, is decreased in accord with it. In this embodiment, too, the nozzle head 1 may be moved by the head moving means 10 by a preset short distance. Or else, the head moving means may be omitted. Instead a plurality of nozzle head units may be fixed and some may be selected from them and operated to perform the same function as the head moving type. This type is applicable to the former embodiment.

In supplying and delivering paper by means of paper supply means 3, paper delivery means 5 and mounting/holding means 4, by supplying and delivering paper once per (1+1/N) rotation, it is possible to supply and deliver paper continuously at regular intervals suited to timing of dot recording and smoothly and efficiently even at low speed without decreasing the time efficiency (number of printed sheets per second, throughput per unit time) and to increase the print quality (image quality). The number of times the standard speed may be below 1 to improve the accuracy of jetting position of ink dot from the inkjet nozzle onto the print medium and decrease the amount of satellites that scatter off the proper position, thereby improving the print quality.

Another embodiment in which the method of moving the nozzle head 1 is improved will be described below as the third embodiment (nozzle head will be hereinafter called line head to make clear that they are line heads having recording elements from the jet nozzles arranged in a line). The same number or mark is used for the same parts as those used in the first embodiment for better understanding.

Figure 14:
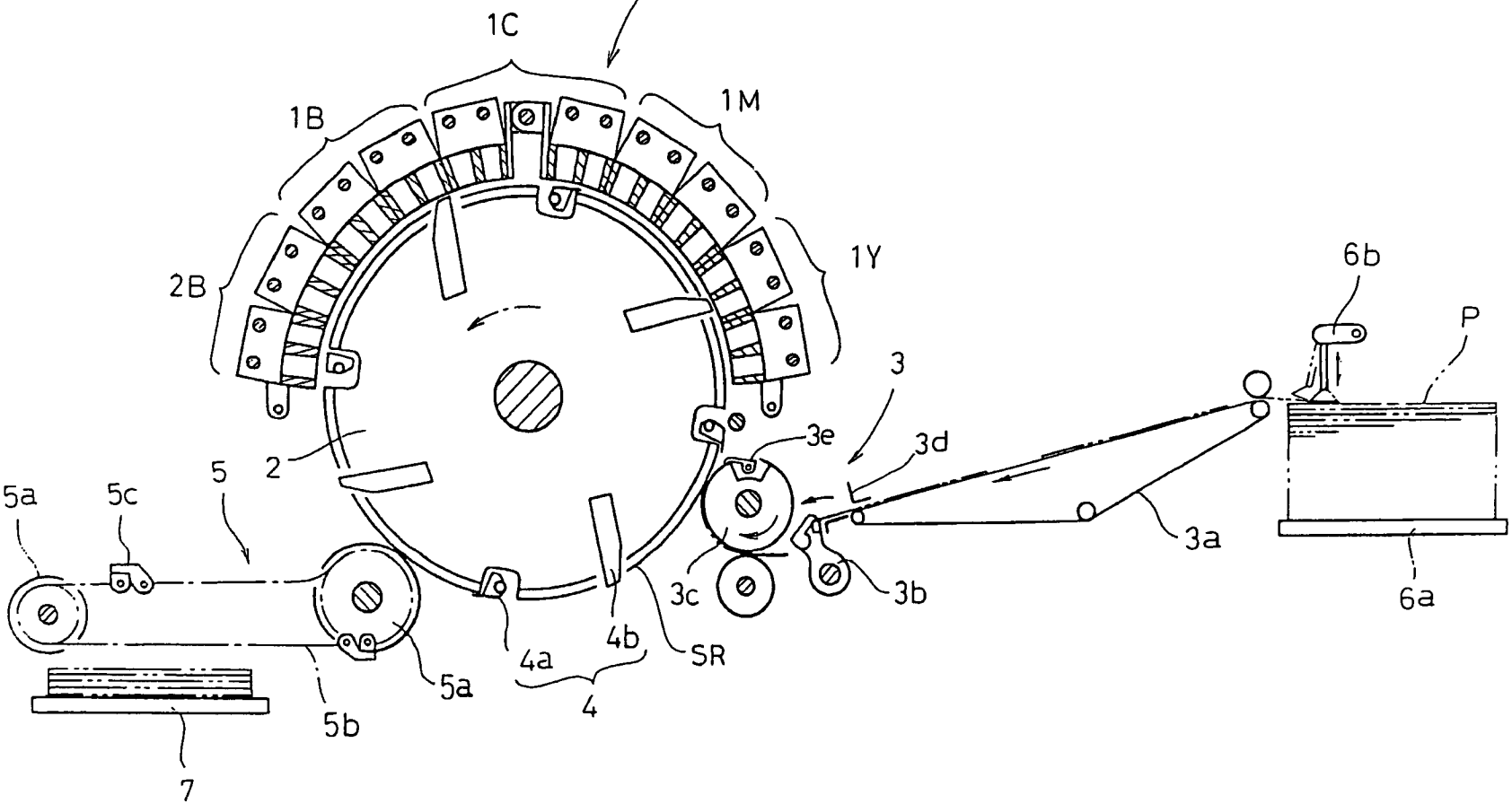

As shown in FIG. 14, the line dot recorder (hereinafter called inkjet printer) of this type comprises a drum 2 on which a sheet-like matter P (printing paper) is mounted, a line head 1 for inkjet, paper supply means 3 and paper delivery means 5, and is controlled by a control means.

The drum 2 has a shaft (cylinder shaft) rotatably supported and coupled with a driving means and a rotating surface SR and is provided with a mounting means 4 for mounting paper P on its rotating surface SR.

The paper mounting means 4 includes a clamping claw 4*a* and a clamp 4*b* for clamping the paper.

The paper mounting means 4 is provided at four points on the rotating surface SR so that four print papers P can be mounted. Also, over the rotating surface SR, line heads 1 for inkjet are provided.

Ten line heads 1 in total are provided for four colors including yellow 1Y, cyan 1C, magenta 1M (two each) and black 1B and 2B (two each), divided into two groups each consisting of five so as to cover the top half of the drum 2. The line heads 1 extend perpendicularly to the rotating direction of the drum.

Because the number of the nozzles is doubled for black which provides thickness in print, overlapping of black dots can be done by a single rotation of the drum 2. This makes possible high-quality printing at high speed. Also, if one of the line heads 1B and 2B should not jet ink, this trouble can be covered by overlapping dots, thereby reducing its mal effects. Further, because the diameter of black dot can be increased above a regular value, a whole surface solid black image can be reliably printed densely even if the dot position accuracy is low. For reference, the amount of ink jet from the nozzle in overlapping dots is preferably 0.5 to 1 time relative to other colors to maintain the dot diameter of ink jet at a regular value.

Also, as shown in FIG. 14, the line heads 1B and 2B for black are arranged downstream of line heads 1Y, 1M, 1C of other colors in the rotating direction of the drum. By doing so, about half of the circumference of the drum before the next printing can be used as the drying time in case the drum is rotated a plurality of times for printing (multi-pass system). This permits the use of an ink having low penetration as a black ink. Also, even if the amount of black ink is increased, longer time can be taken for drying.

Figure 15:
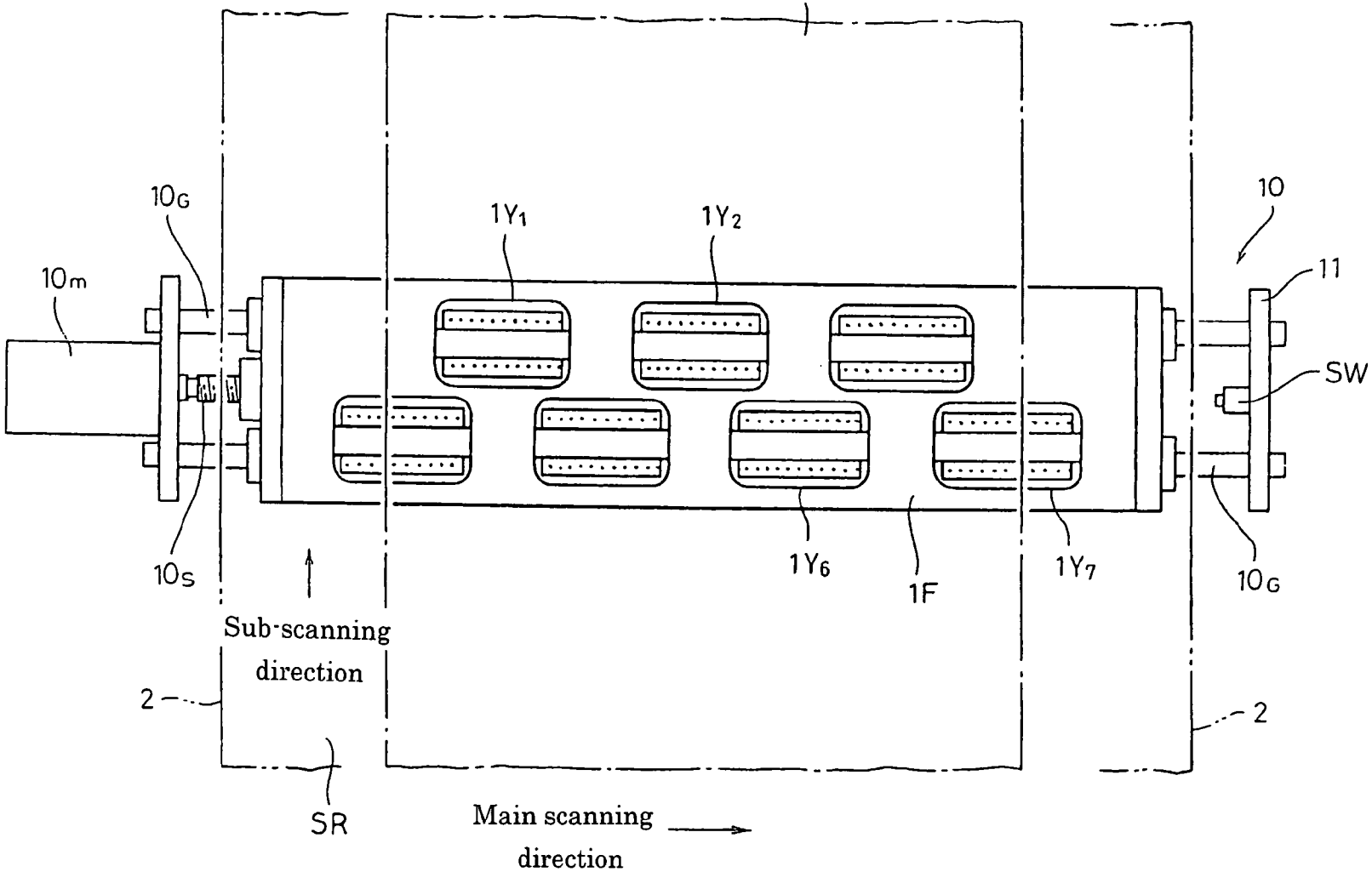

The line heads 1Y, 1C, 1M, 1B, 2B for each color have two line head units (hereinafter carriage 10) as shown in FIG. 15 (line heads for yellow 1Y shown). Each carriage 10 has 14 short line heads $\mathbf{1}_{Y1\text{-}7}$ arranged on the support frame 1F in staggered fashion to form a long line head unit having a larger print range than the paper P as shown in FIG. 15. Two rods 10G extend through the support frame 1F as shown in FIG. 15 and a ball screw 10S extends in the center. The carriage 10 is moved by rotating the ball screw 10S by a stepping motor 10*m*. To prevent the support frame 1F from colliding and to permit returning to zero point, a switch SW for position detection is provided on a fixed frame 11 of the carriage 10 and connected to a control means.

Figure 16:
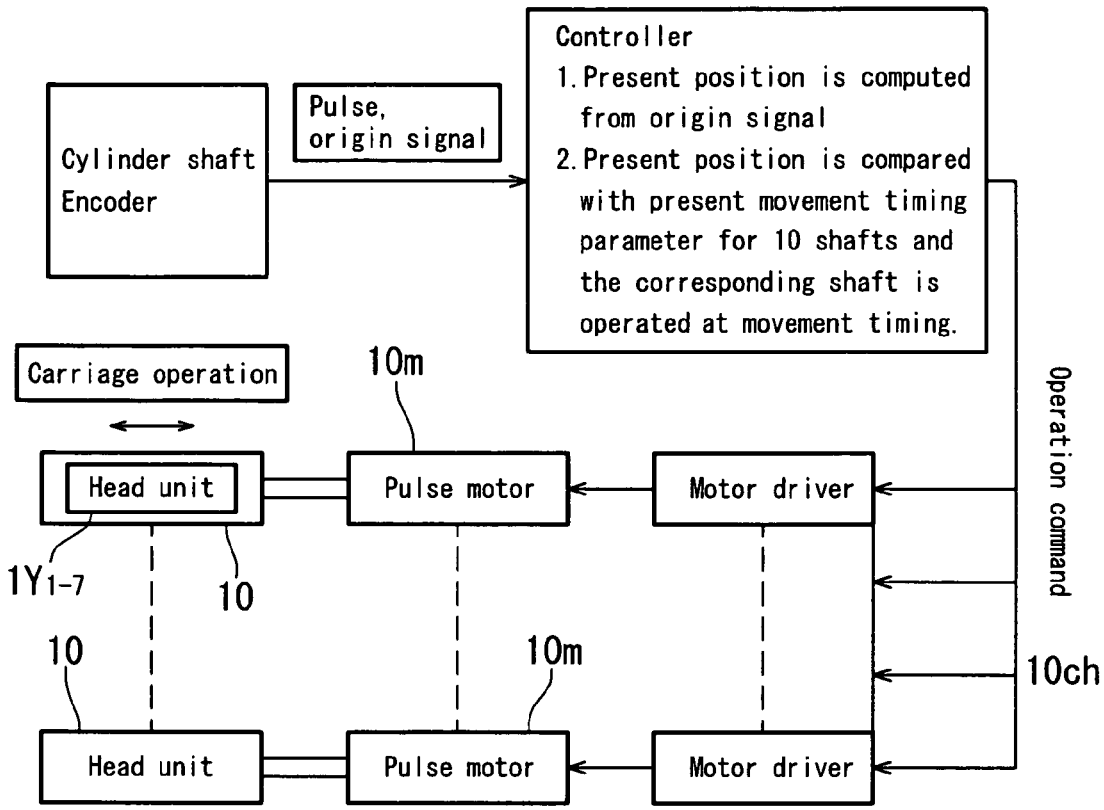

As shown in FIG. 16, the stepping motor 10*m* is connected to a control means (e.g. a personal computer) through a motor driver so that the carriage 10 for each color can be controlled individually. For this purpose, an encoder (optical, one with an absolute address will do. One which produces a serial pulse and is combined with a counter to output an absolute address from an origin will do. One which can be used as a position sensor such as a potentiometer will do) is provided on a shaft of the drum 2 and the output of the encoder is inputted to the control means.

This arrangement makes it possible to compute the origin position of the drum 2 from the origin signal and compute the timings for moving the line heads 1Y, 1C, 1M, 1B, 2B from the computed origin position individually.

Thus, by comparing the computed present positions of the carriages of the line heads 1Y, 1C, 1M, 1B, 2B with the preset moving timings of these line heads, the carriages 10 of the line heads can be moved.

The paper supply means 3 comprises a paper feed roller 3*c* and a pivoting gripper 3*b*. The latter grips one end of the paper P fed one by one by a conveyor 3*a* from a paper supply tray 6*a* (storage case in the first embodiment), pivots as shown by arrow in FIG. 14 and feeds it to the paper supply roller 3*c*.

The paper supply tray 6*a* has a suction arm 6*b* which supplies paper P one by one to the conveyor 3*a* (by command from the control means). The conveyor 3*a* is provided with a registering means 3*d* to align the paper P widthwise and longitudinally. The gripper 3*b* grips the paper supplied from the conveyor 3*a* and feeds it to the paper supply roller 3*c*. The roller 3*c* grips one end of the paper with a claw 3*e*, turns as shown by arrow in FIG. 14 and hands the paper to the claw 4*a* of the drum 2.

The paper delivery means 5 comprises a paper delivery roller 5*a*, a chain 5*b* attached to the roller 5*a*, and a gripping claw 5*c* attached to the chain 5*b*. The gripping claw 5*c* takes out the printed paper P, and the paper delivery roller 5*a* turns to feed the paper to a storage tray 7 (storage case in the first embodiment).

Though not shown, the paper supply roller 3*c* and the paper delivery roller 5*a* are provided with a sensor (e.g. optical encoder or potentiometer) connected to the control means. The encoder provided on the shaft of the drum 2 can be used not only for the control of the line head 1 but also for control of the speed of the drum 2 and the timing of paper supply and paper delivery.

The structure is as described above. Next, the operation will be described with reference to FIGS. 17 to 24.

Figure 17:
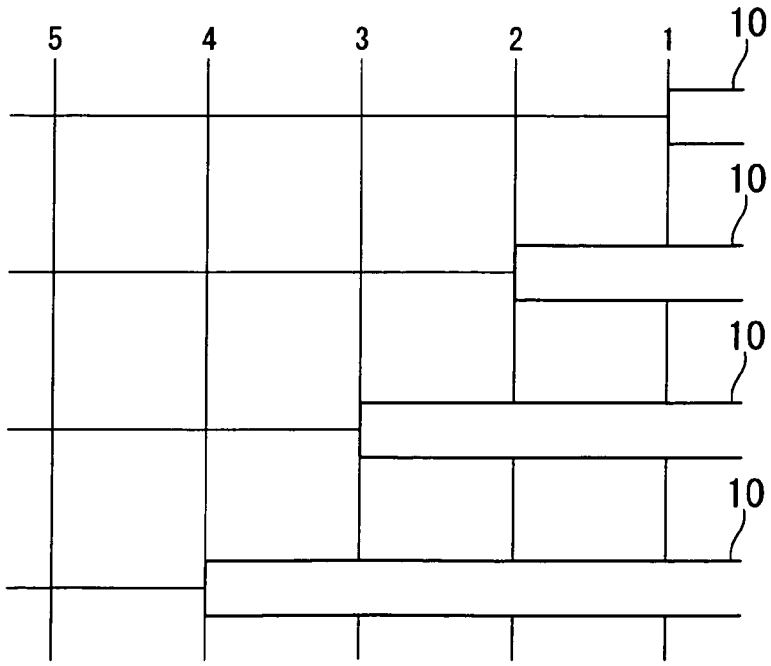

With this ink jet printer, when it starts printing, the carriages 10 of the line heads 1Y, 1C, 1M, 1B, 2B of each color move in the first scan direction. In moving so, the carriage 10 takes one of the four positions as shown in FIG. 17. The larger the moving distance, higher quality print is possible. For example, if unevenness due to non-jetting is present, too small movement of the carriage 10 results in insufficient dispersion of unevenness, so that unevenness is noticeable to the human eye.

Although actually ten carriages 10 are provided, only one is described since all perform the same operation. Also, although the line heads 1Y, 1C, 1M, 1B, 2B cover the upper half of the drum 2 as shown in FIG. 14, individual carriages 10 are located at ¼ area in top right or top left of the drum 2 as shown in FIG. 14. Here, the area E shown in FIG. 18 (*b*) is described as the print area for convenience. Thus, when the carriage 10 is located in the left area, the left area is the print area.

Figure 18:
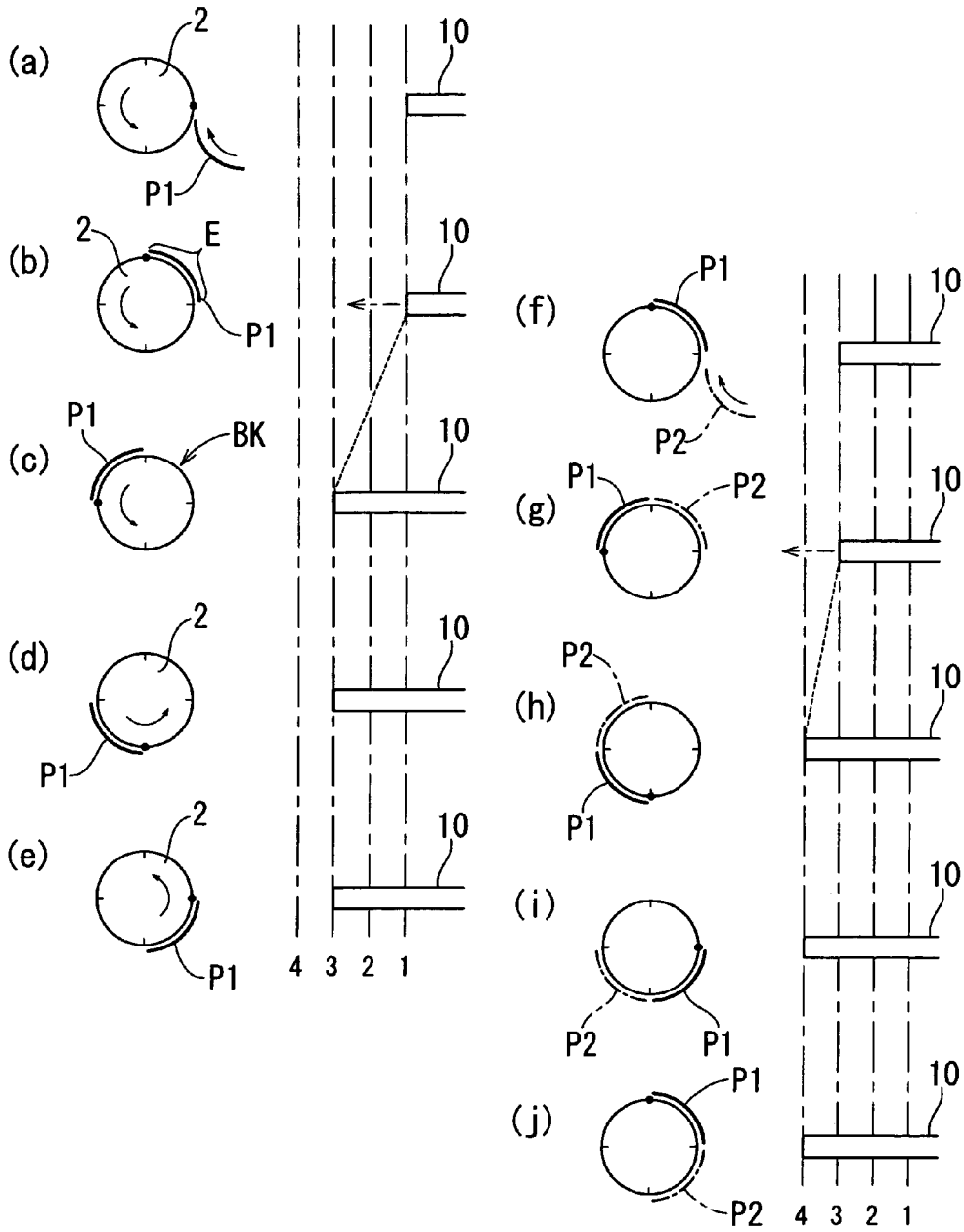

First, as shown in FIG. 18(*a*), the first paper P1 is supplied to the drum 2. It is supplied from the paper tray 6*a* by the suction arm 6*b* and the conveyor 3*a* to the paper supply means 3, which hands the paper to the gripping claw 4*a* and mount it on the drum 2. At this time, the carriage 10 is at position 1.

When the first paper P1 is mounted on the drum 2 and reaches the print area E of the carriage 10, it is printed by the first rotation of the drum. This printer adopts the multi-pass print system and forms one image per four rotations of the drum 2. Thus, the printing on the first paper P1 by the first rotation is done at (a, 1), (c, 1), (b, 3) and (d, 3) as shown in FIG. 22 (*a*), that is, every one dot so that dots will not overlap the dots from the adjacent nozzles or will not overlap the dots in the adjacent lines.

Figure 22:
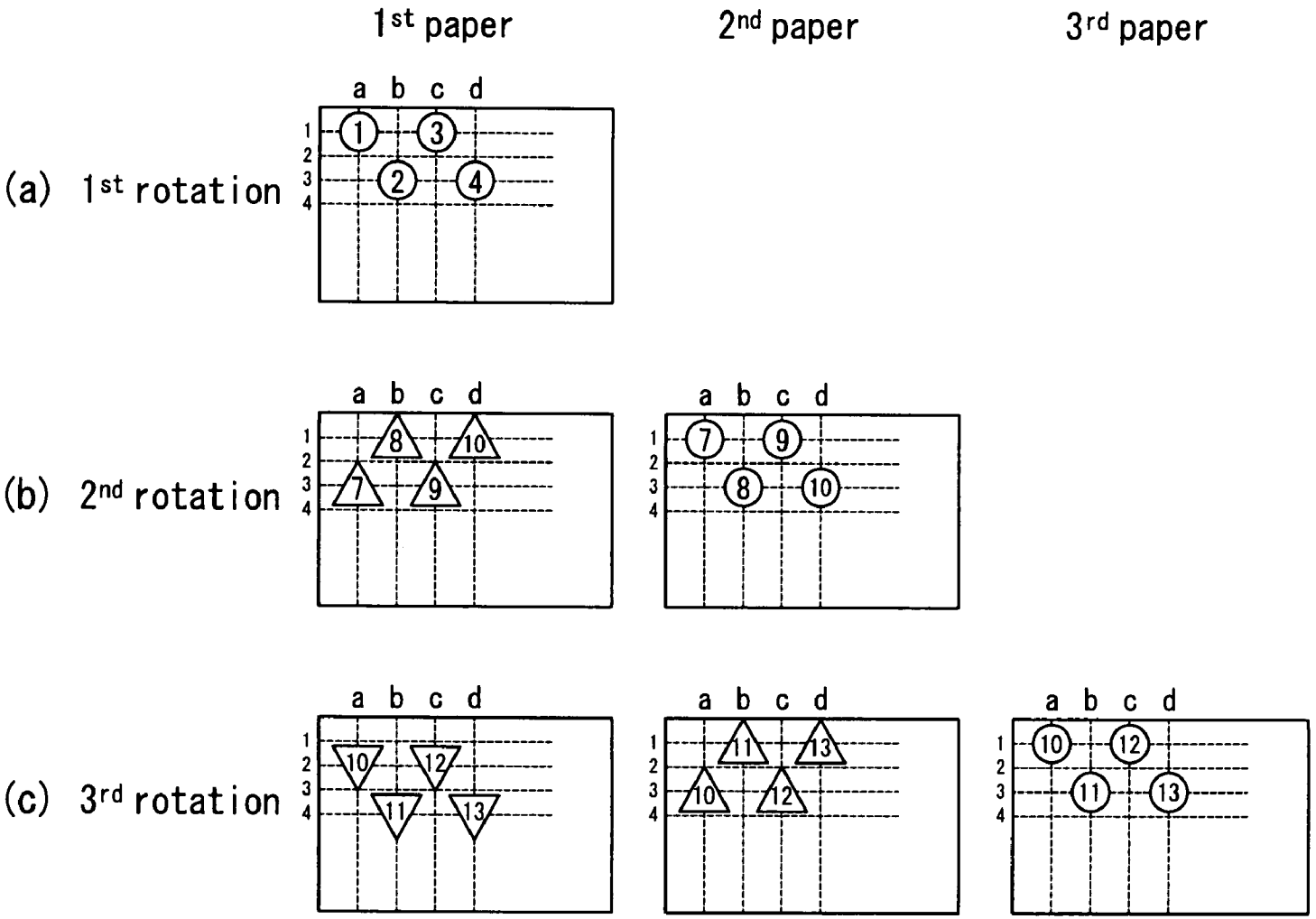
Figure 23:
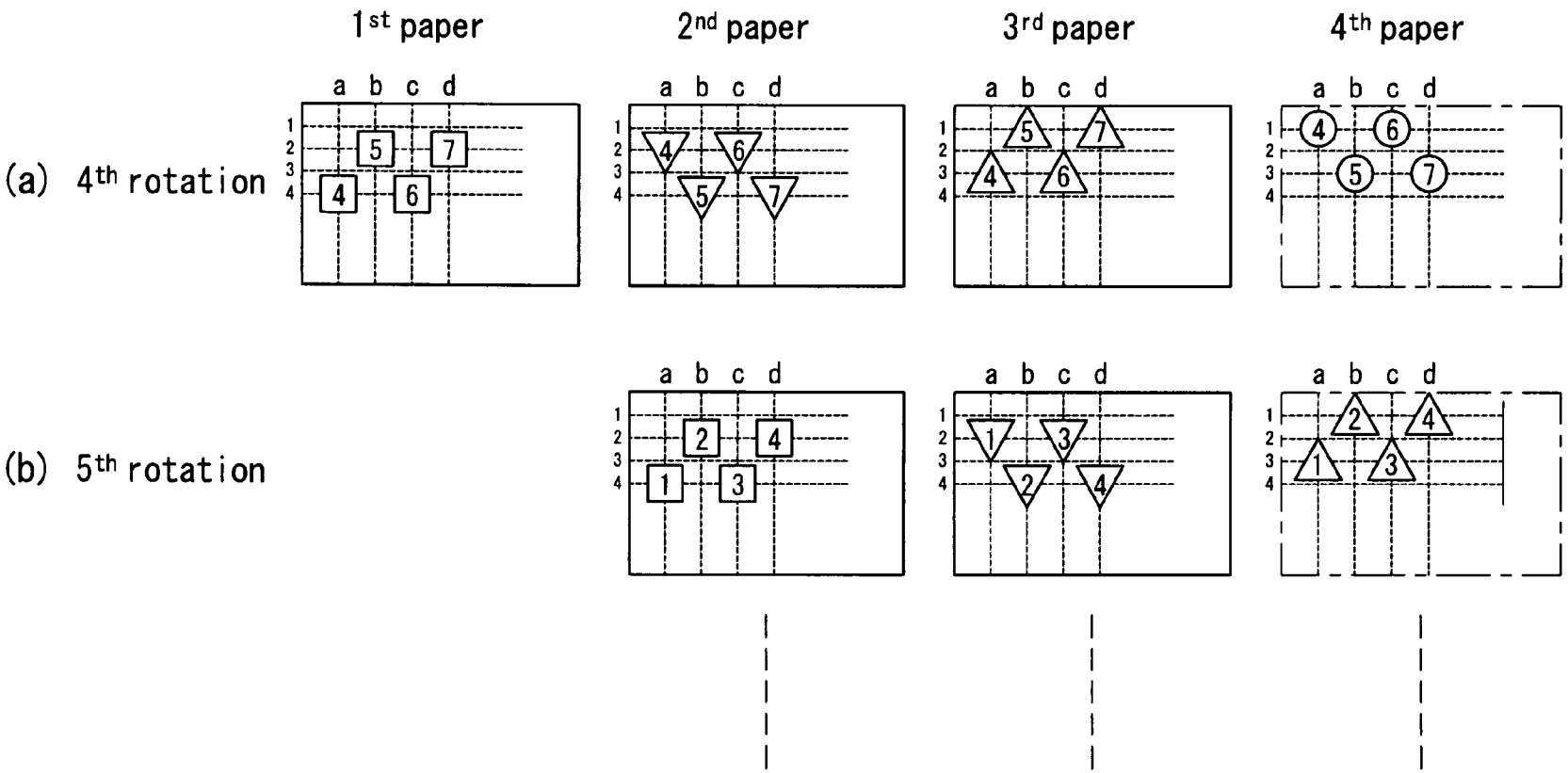

FIGS. 22 and 23 show one image model schematically to explain the multi-pass system adopted in this application. The figures (1 to 13) in ○ or ∇ are used to distinguish the nozzles used to print dots. The dots with the same number are printed by the same nozzles.

When the print upon the first rotation ends and the first paper passes the print area E, the blank area BK comes where the first paper is not mounted as shown in FIG. 18(*b*) to (*e*). At this timing, the carriage 10 is moved in the first scan direction (widthwise direction of the drum 2) as shown in FIG. 18(*c*).

When the drum 2 finishes the first turn and starts the second turn as shown in FIG. 18(*f*), the print of second pass to the first paper P1 starts at (b, 1), (d, 1), (a, 3), (c, 3) as shown in FIG. 22(*b*). Next, mounting of the second paper P2 on the drum and printing of first pass to the second paper are done as shown in FIG. 18(*g*). Namely, the second paper is printed at (a, 1), (c, 1), (b, 3), (d, 3) as shown in FIG. 18(*b*). Because the nozzles used this time are different from those used in the printing by the first turn, failure in printing due to non-jet nozzles can be covered. This is one effect of multi-pass printing.

When print on the second paper P2 ends as shown in FIG. 18(*g*), the blank area BK comes where neither the first paper nor the second paper is mounted. At this timing, the carriage 10 is moved in the first scan direction. For example, it is moved as shown in FIG. 18(*h*) (to position 4).

Figure 19:
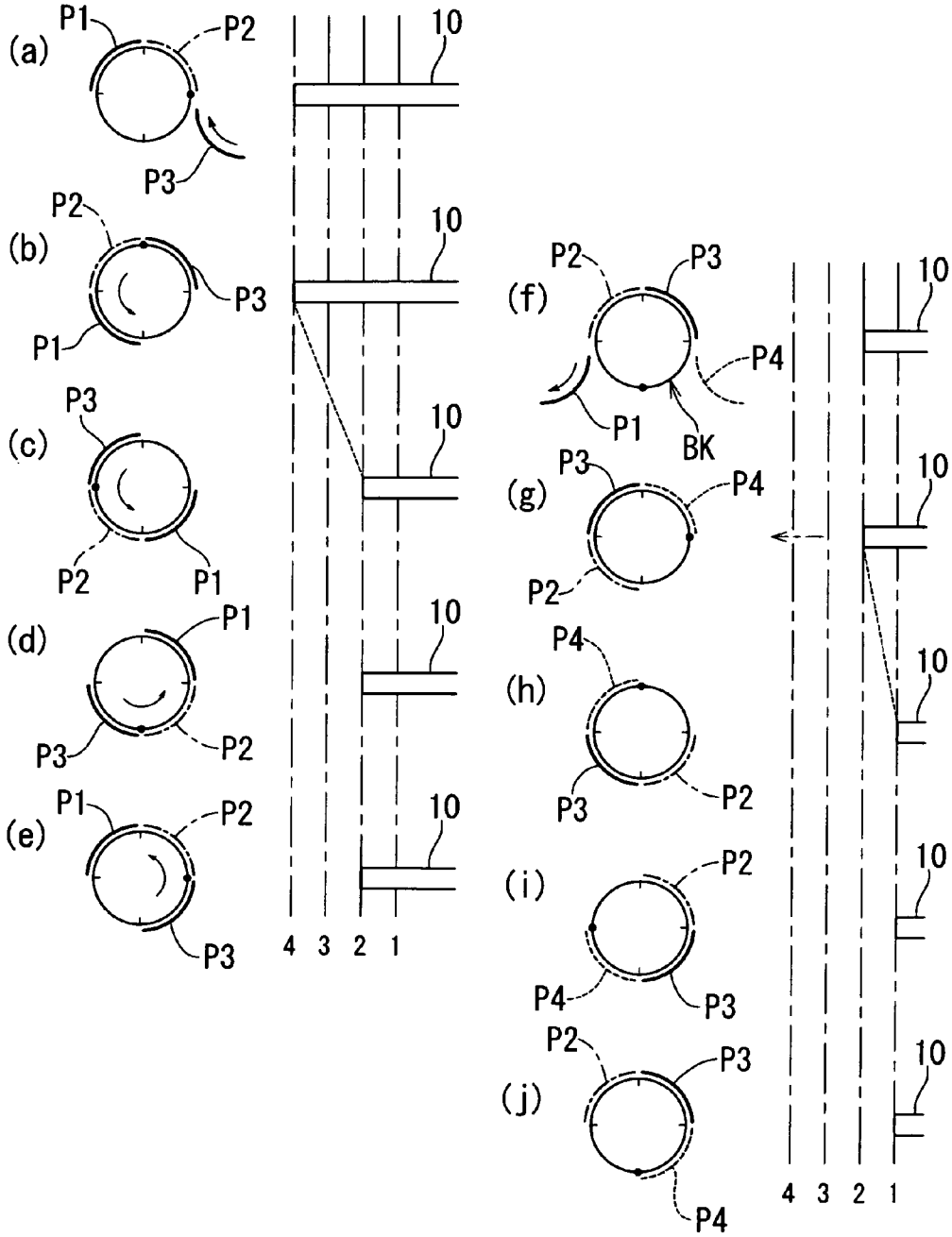

When the drum 2 finishes the second turn and starts the third turn as shown in FIG. 18(*i*), print by third pass to the first paper P1 is done as shown in FIG. 18(*j*), and print by second pass to the second paper P2 is done as shown in FIG. 19(*a*). Namely, the first paper is printed at (a, 2), (c, 2), (b, 4), (d, 4) and the second paper is printed at (b, 1), (d, 1), (a, 3), (c, 3) as shown in FIG. 22(*c*).

The third paper P3 is mounted as shown in FIG. 19(*a*) and printed for the first time (by first pass) as shown in FIG. 19(*b*). As shown in FIG. 22(*c*), the third paper is printed at (a, 1), (c, 1), (b, 3), (d, 3).

The nozzles used for printing the first, second and third papers by the third turn differ from those used at the first and second turns as shown in FIG. 22(*a*), (*b*) and (*c*) because the carriage 10 is advanced as shown in FIG. 18(*h*). This makes it possible to minimize the effect of failure in printing due to non-jet nozzles.

When print to the third paper ends, the blank area BK comes where the first, second or third papers are not mounted as shown in FIG. 19(*c*). Thus, the carriage 10 is moved as shown in FIG. 19(*b*)-(*c*).

When the drum 2 ends the third turn and starts the fourth turn as shown in FIG. 19(*c*), the fourth print (fourth pass) is done to the first paper as shown in FIG. 19(*d*), the third print (third pass) is done to the second paper as shown in FIG. 19(*e*), and the second print (second pass) is done to the third paper as shown in FIG. 19(*f*). Namely, as shown in FIG. 23(*d*), the first paper is printed at (b, 2), (d, 2), (a, 4), (c, 4) and the second paper is printed at (a, 2), (c, 2), (b, 4), (d, 4), and the third paper is printed at (b, 1), (d, 1), (a, 3), (c, 3). This completes the printing of the first paper. When the first paper reaches the delivery point as in FIG. 19(*f*), it is delivered by the paper delivery means 5. At the same time, the fourth paper P4 is mounted.

The drum 2 ends the fourth turn at FIG. 19(*g*) and starts the fifth turn. The first print (first pass) to the now mounted fourth paper P4 is done at (b, 1), (d, 1), (b, 3), (d, 3) as shown in FIG. 23(*e*).

When the first print to the fourth paper ends, the blank area BK comes as shown in FIG. 19(*h*), and the carriage 10 is moved to position 1. When the movement to position 1 ends, the fourth print (fourth pass) is done to the second paper P2 as shown in FIG. 19(*i*). Then the third print (third pass) is done to the third paper P3 as shown in FIG. 19(*j*). As shown in FIG. 23(*e*), the second paper is printed at (b, 2), (d, 2), (a, 4), (c, 4) and the third paper is printed at (a, 2), (c, 2), (b, 4), (d, 4).

Figure 20:
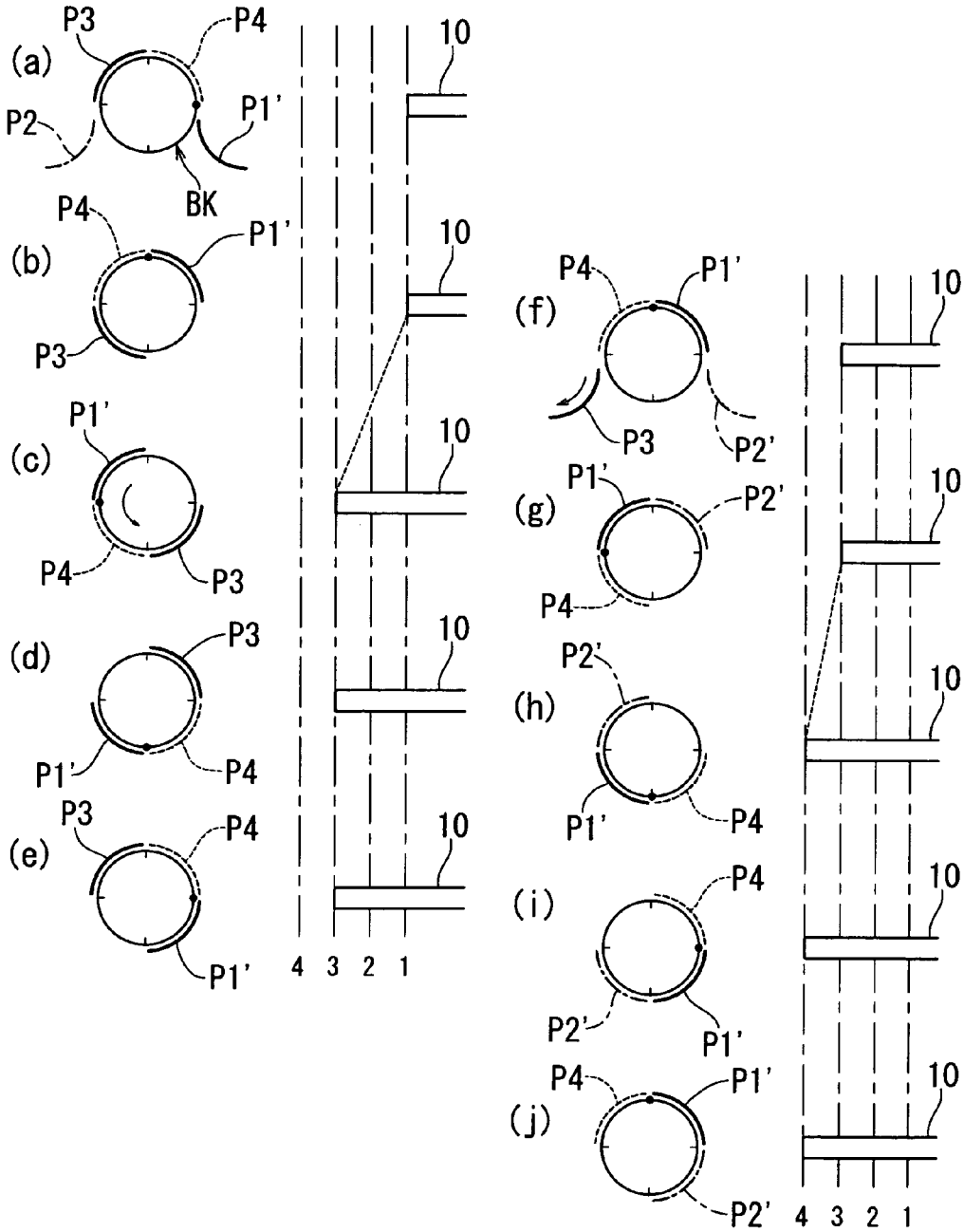
Figure 21:
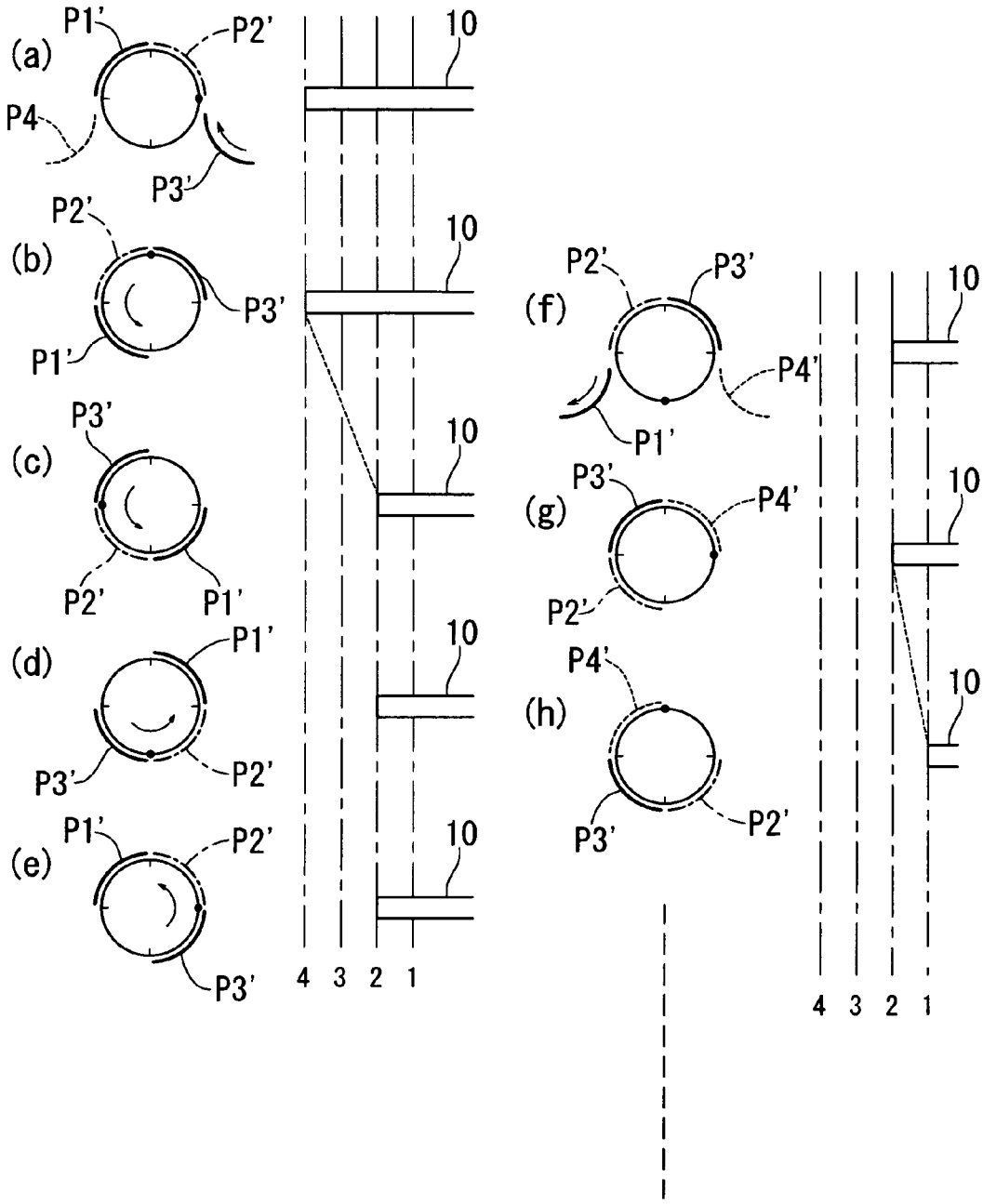

This completes printing to the second paper, which is delivered by the delivery means 5 as shown in FIG. 20(*a*). In FIG. 20(*a*), the second print (second pass) is done to the fourth paper and the fifth paper P1' is mounted.

In FIG. 20(*b*), print is done to the fifth paper P1'. At this time, the carriage 10 is in position 1. For multi-pass printing, with the position 1 as the start point, steps from FIG. 22(*a*) to FIG. 23(*e*) are repeated.

As described above, the carriage 10 is moved in the order of position 1→3→4→2→1. If the carriage were moved in the order of position 1→2→3→4→1, the distances for moving 1→2, 2→3, and 3→4 would be small, but the distance for moving 4→1 would be extremely large and the acceleration then would be extremely large. In contrast, moving the carriage in the order of 1→3→4→2→1 makes it possible to keep the maximum moving distance and the maximum acceleration to low levels. By keeping the maximum value of acceleration low in moving the carriage, it is possible to minimize the mal effect of the acceleration during the movement of carriage upon the jetting of ink from the nozzles.

After the paper supply at start of printing, printing is carried out with three papers always mounted on the drum 2.

Next, a description will be made about the movement of the carriage 10 of the line heads 1Y, 1C, 1M, 1B, and 2B.

When the first print to the fifth paper P1' ends in FIG. 20(*b*), the blank area BK comes. At this timing, the carriage 10 is moved to position 3 as shown in FIG. 20(*c*) before the third paper P3 reaches the print area E.

Figure 24:
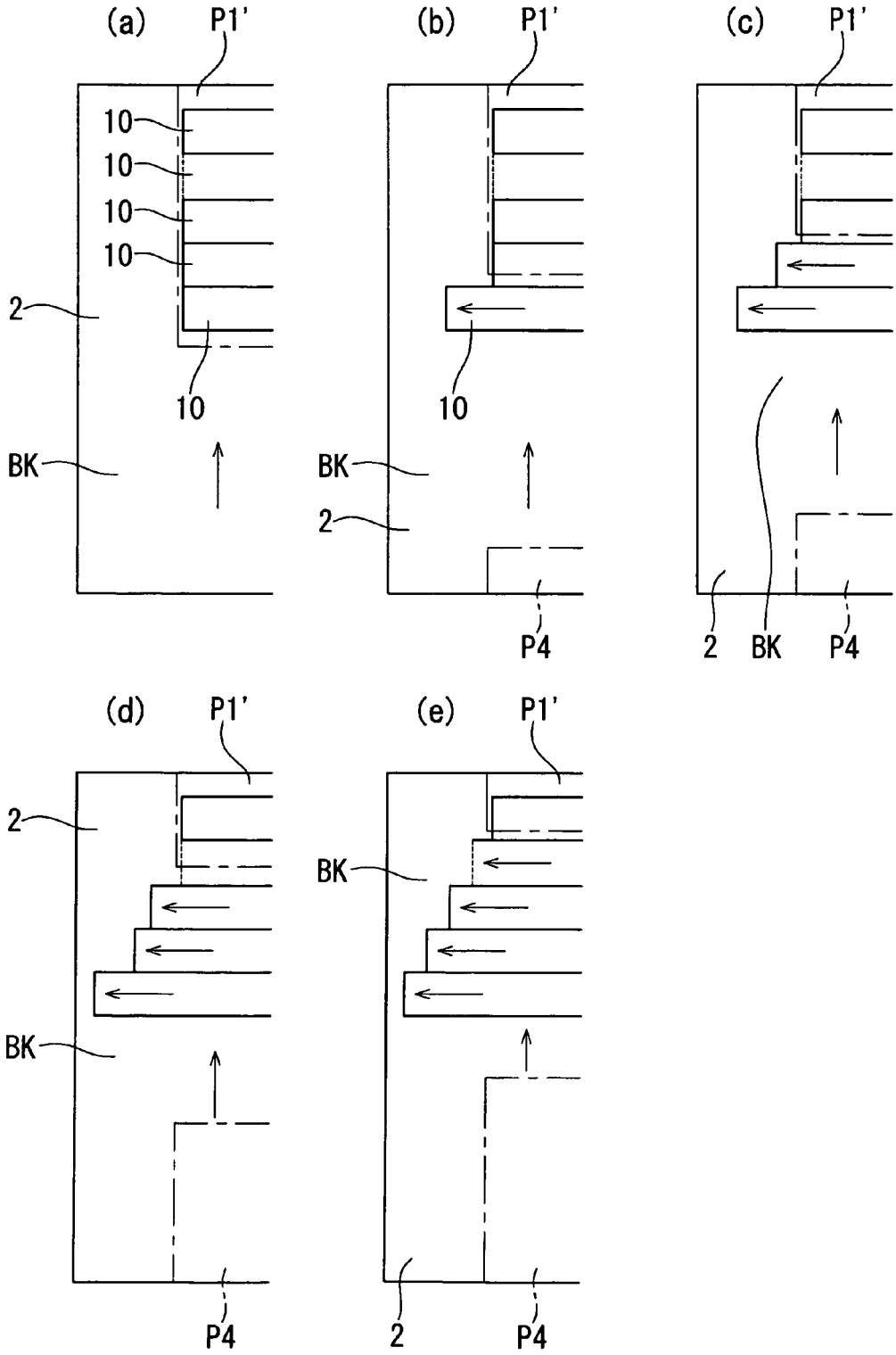

As shown in FIG. 24(*a*) to (*e*), the movement of the carriage is started the instant when the paper end of the preceding paper P1' (e.g. FIG. 20(*b*)) has passed under the carriage and is finished just before the paper head of the next paper P4 comes, using the blank area BK. Similarly, the remaining carriages 10, too, start the movement one after another the instant when the paper end has passed and completes the movement just before the paper head of the next paper comes. By starting the movement the instant when the paper end has passed and completing it just before the paper head of the next paper comes, all the carriages 10 can make use of the blank area BK equally. By moving each carriage 10 relatively slowly using the blank area BK (sufficient time is given for the line heads to move by use of an area which is originally for printing), it is possible to keep low the acceleration applied to the carriage 10 and prevent the ink in the line heads 1Y, 1C, 1M, 1B, 2B from being acted by undue pressure, thereby preventing the jetting performance from impairing and permitting high-accuracy high-quality printing.

The position of the papers mounted on the drum 2 and the position of the blank area BK formed with the papers mounted can be detected by the signals from the encoder when supplying the papers (the position of the carriage 10 for each color is decided beforehand) and controlled from the control means.

Next, the fourth print is done to the third paper P3 at FIG. 20(*d*). At FIG. 20(*e*), the third print is done to the fourth paper P4. At FIG. 20(*f*), the third paper P3 printed for the fourth time is delivered and the fifth paper P1' is printed for the second time, and the sixth paper P2' is mounted. When at FIG. 20(*g*) the sixth paper P2' is printed, the blank area BK comes. So the carriage 10 is moved before the fourth paper P4 reaches the print area E.

Thereafter, each time when the drum 2 makes 1+1/N rotation, a new paper P is supplied behind the paper mounted. Also, when the blank area BK comes under the carriage 10, the carriage is moved. The operation is shown in FIG. 20(*h*) to FIG. 21(*h*).

This ink jet printer is provided with a blank area BK. So it is possible to move the carriage 10 without decreasing the drum speed. Also, one printing is completed by printing a plurality of times (multi-pass system). The carriage 10 is moved for every printing and the total distance of movement of the carriage is large. By doing so, failure in printing due to non-jet nozzles can be dispersed. Also, print quality can be improved by the effect of multi-pass system.

Therefore, if unevenness due to non-jetting is present, high quality printing is possible because the total moving distance of the carriage is large. If the distance is small, unevenness is not sufficiently dispersed and left noticeable.

In addition, because the carriages 10 are moved one after another and each carriage can be moved at a relatively slow speed, undue pressure will not be applied to the ink in the line heads, so that high chroma accuracy printing is possible.

Therefore, even with the line heads having short heads arranged in staggered fashion, it is possible to avoid the formation of streak unevenness on the image at the portions between the heads, and thus high-quality printing at high speed is possible. Also, it is possible to minimize the time loss produced between the passes in moving the heads. Thus printing can be done while maintaining the operation efficiency of the heads at maximum.

Although in the embodiments the carriages of the line heads of each color are moved, the arrangement is not limited to it. The line heads may be moved by means of other motor-driven moving means.

Further, the margin of paper (no print portion) following the blank area may be used for the position change of the carriages or the line heads. With the room provided by the margin, it is possible to increase the moving distance of the carriage or line head or increase the drum speed, thereby increasing the print speed.

Next, a cleaning apparatus for preventing the image quality of the line head recorder from impairing will be described below as the fourth embodiment. The same marks or numbers are used for the same parts as those used in the first embodiment.

Figure 25:
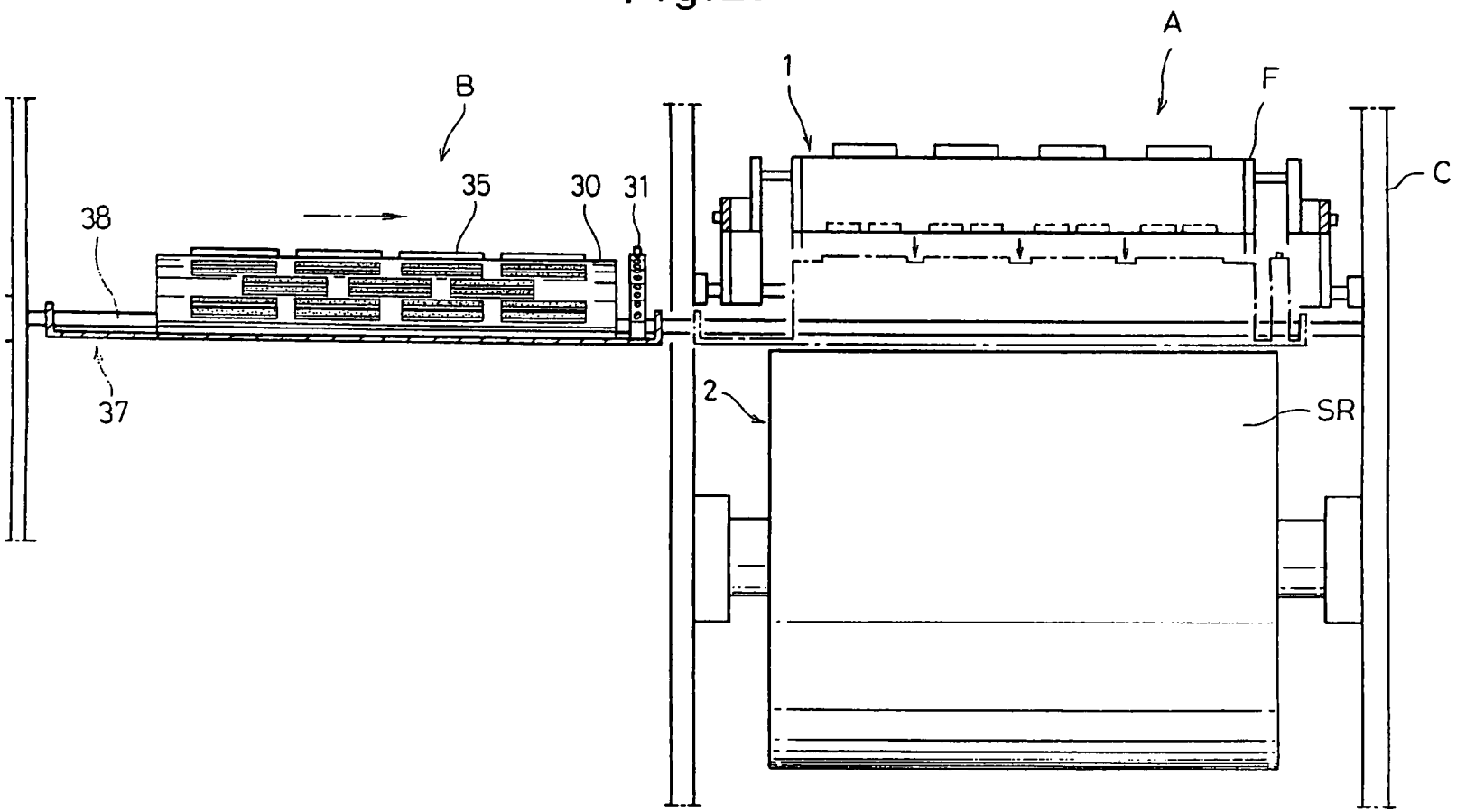

The line head recorder (hereinafter ink jet printer), as shown in FIG. 25, comprises the printer proper A and a cleaning apparatus B.

Figure 26:
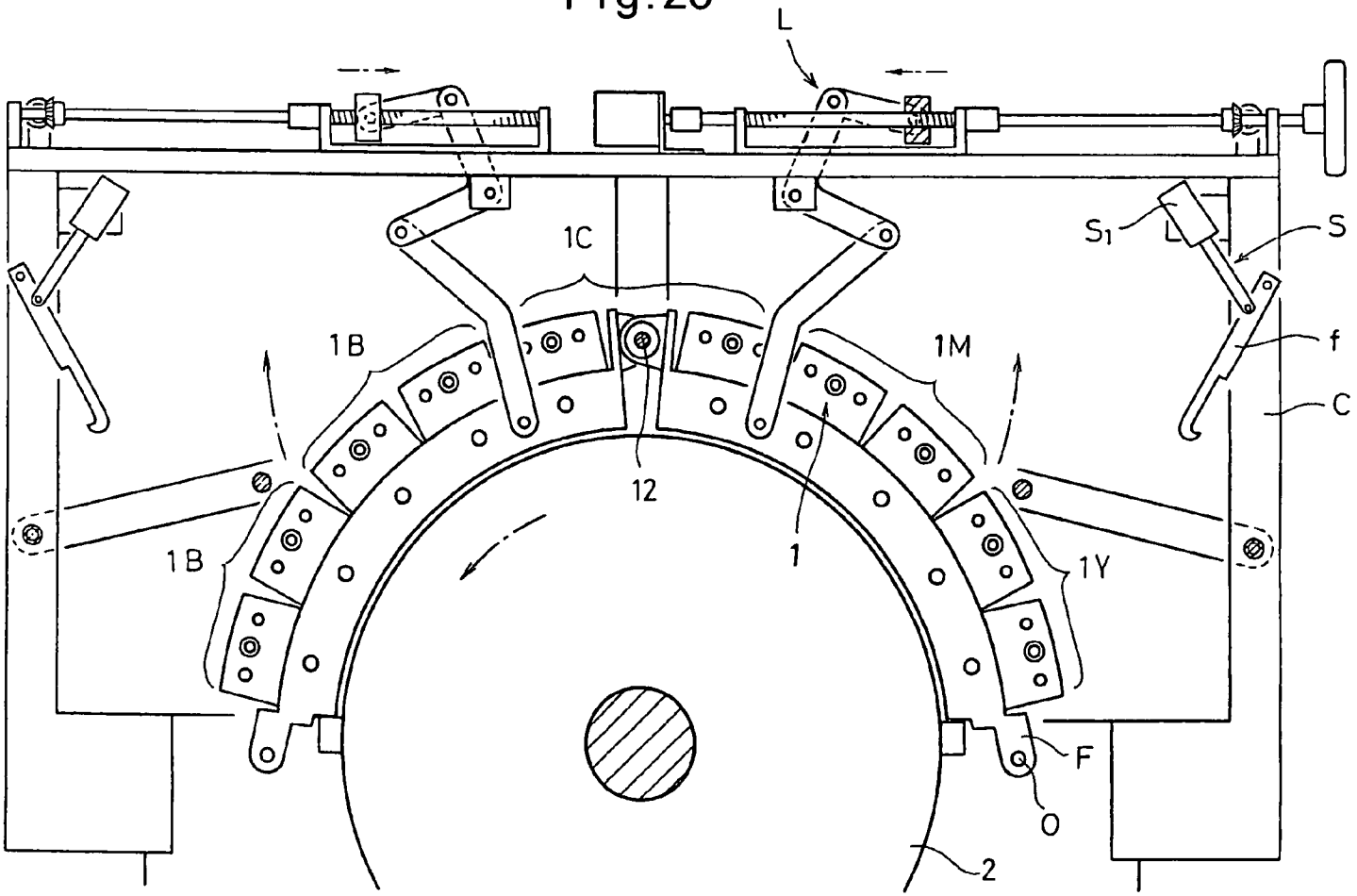

As shown in FIG. 26, the printer proper A comprises a drum 2 on which a sheet-like matter to be printed (print paper P) and a line head 1 for inkjet, and is supported by frame C. Though not shown in FIG. 25 or 26, it is provided with a paper supply means and a paper delivery means and is controlled by a control means.

The drum 2 has a shaft rotatably supported, a drive means such as a motor, and a mounting means for mounting the paper P on its rotating surface SR.

The mounting means comprises gripping claws and clamps. One end of the paper P is gripped by the gripping claw and its other end is held by the clamp.

The mounting means is provided at four points of the rotating surface SR of the drum to mount four print papers. Over the rotating surface SR of the drum, the line head 1 for inkjet is provided.

A total of ten line heads 1 are provided including yellow 1Y, cyan 1C, magenta 1M, black 1B for four colors (two each for yellow 1Y, cyan 1C and magenta 1M and four for black 1B). Ten line heads are divided into two groups, five for each group. As shown in FIG. 26, the line heads 1 are mounted on a frame supported by a fulcrum shaft 12 so as to extend perpendicularly to the rotating direction of the drum 2. The frame (hereinafter wing frame F) is pivotally mounted. The frame F is provided with a link mechanism as an elevating means L driven by a motor. The link mechanism has a link mounted on a slider threadedly engaging a ball screw. The wing frame F can be opened and closed to three positions, that is, purge position a, suction position b, and print position.

Figure 27:
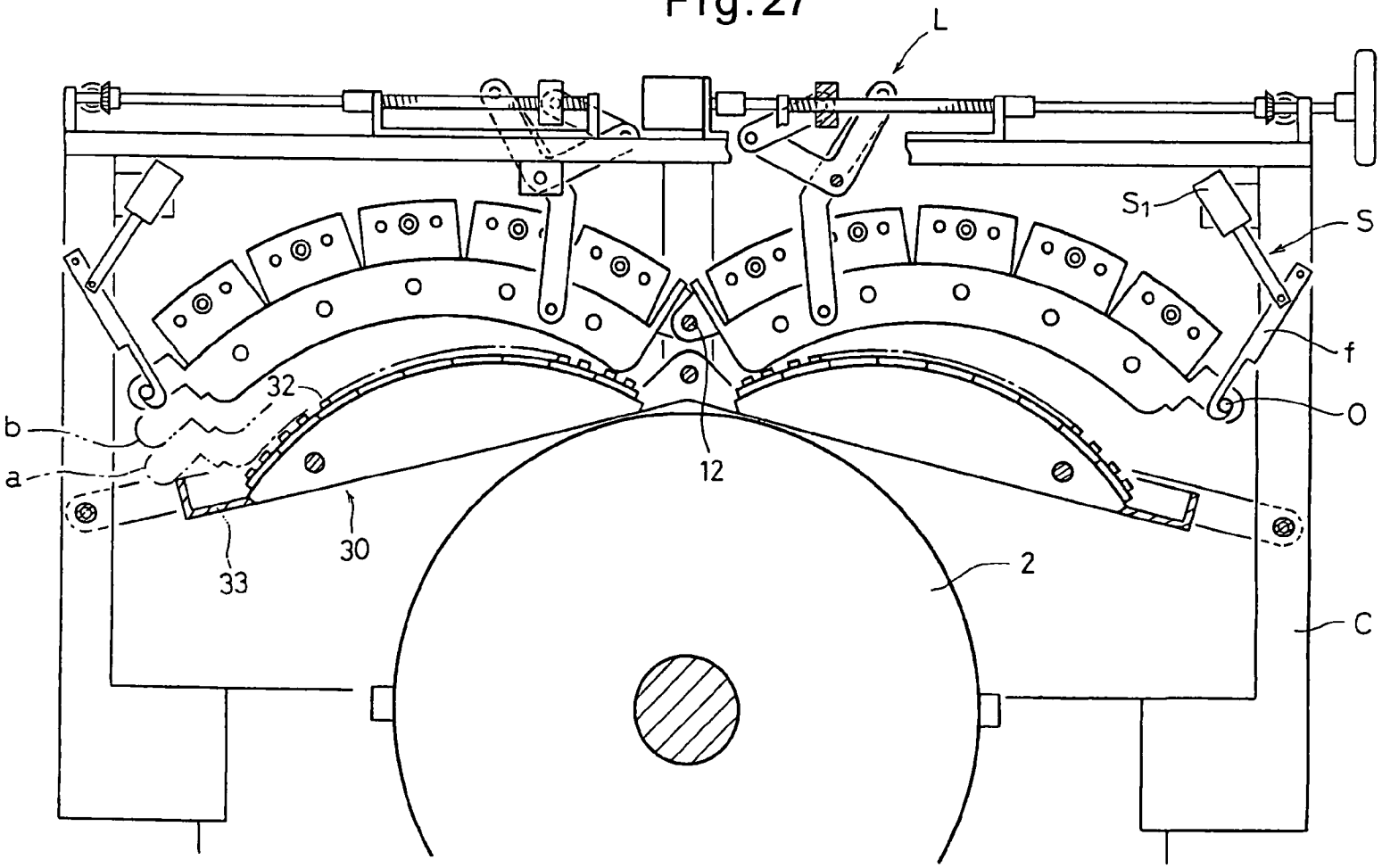

The wing frame F has a shaft O at both ends thereof, the shafts each being engaged with a hook f on the frame C to keep the wing frame in its open state. A cylinder mechanism S is provided to engage and disengage the hook f. As shown in FIG. 27, the cylinder mechanism S has a cylinder S1 coupled with the hook f through a link work. The rod of the cylinder S1 advances to move the hook f up and down to engage and disengage it.

By opening the wing frame F, it is possible to increase the distance between the drum 2 and the line heads 1, thereby providing a large work space. This facilitates the checking and maintenance of the nozzle surfaces of the line heads 1, thereby improving the workability.

Figure 28:
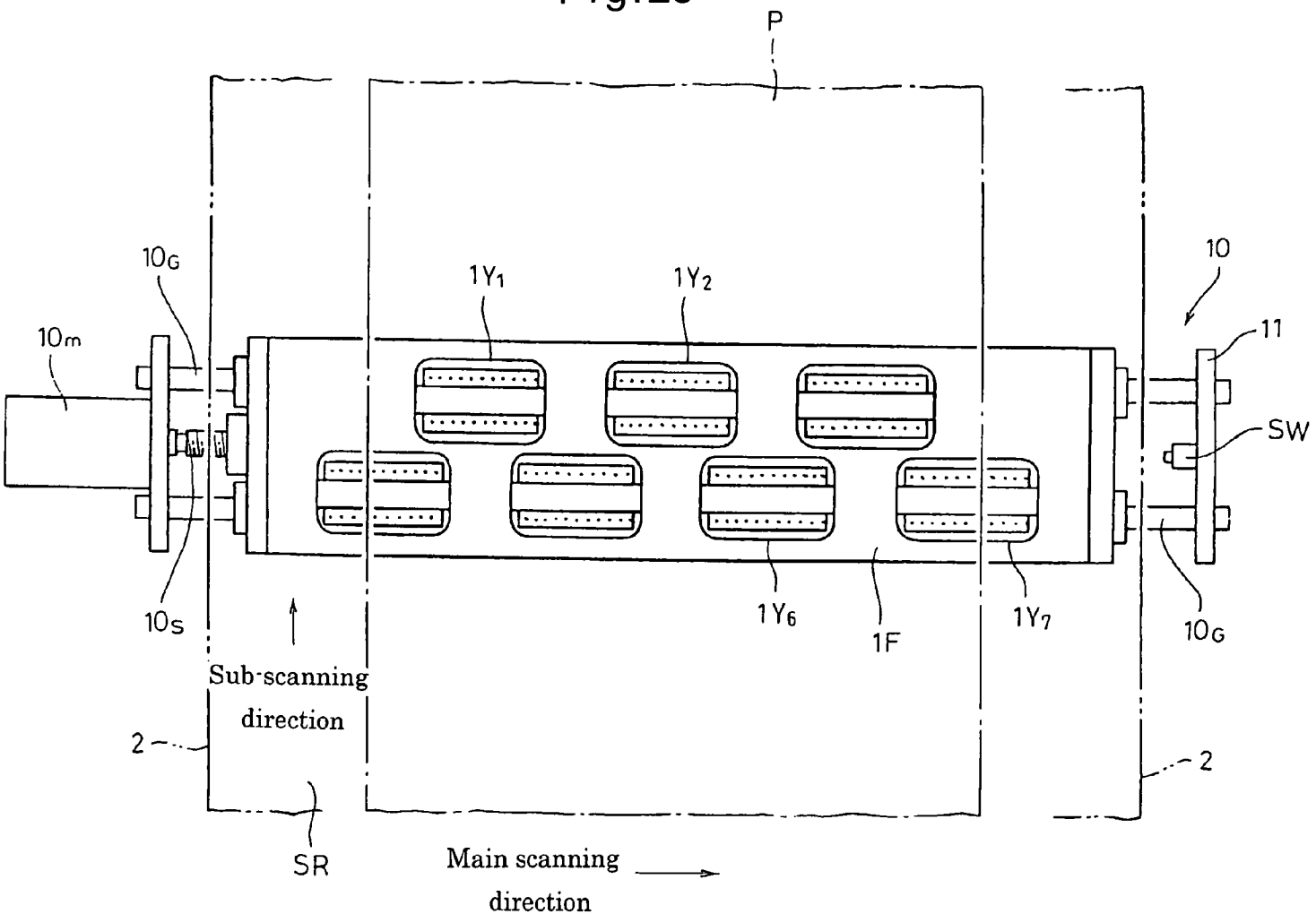

The line head 1Y, 1C, 1M, 1B of each color (e.g. line head of yellow 1Y) has two line head units 10 (hereinafter carriage) as shown in FIG. 28. Each carriage 10 comprises 14 short line heads $\mathbf{1}_{Y1\text{-}7}$ on the supporting frame 1F in staggered fashion, thereby forming a long unit having a larger print range than the paper P as shown in FIG. 28.

As shown in FIG. 28, the support frame 1F has a pair of rods 10G extending through it and a ball screw 10S threadedly engaging in the center. By rotating the ball screw 10S by means of a stepping motor 10*m*, the support frame 1F can be moved right and left in FIG. 28. A switch SW for position control is provided on the fixed frame plate 11 of the carriage 10 and controlled from a control means to avoid collision of the support frame 1F and return to zero point.

The paper supply means, though not shown in FIG. 25 and FIG. 26, comprises a paper supply roller and a pivoting gripper. The latter grips one end of the paper supplied one by one from a paper tray through a conveyor and pivots to feed the paper to the paper supply roller.

The paper supply roller grips one of the paper P with its claw and rotates to feed the paper to a gripping claw of the drum 2.

The paper delivery means, though not shown FIG. 25 and FIG. 26, comprises a paper delivery roller and a chain attached to the roller and fitted with gripping claws. As the paper delivery roller rotates, the gripping claw takes out the paper and feeds it to a print tray.

The rotary shaft of the drum 2, paper supply roller and paper delivery roller are provided with sensors (not shown) such as optical encoders and potentiometers) that are connected to the control means so that they can be controlled by the control means. Also, the shaft of the drum 2 is provided with an encoder so that the control means can control not only the line head 1 but the speed of the drum and the timing of paper feed and delivery.

Figure 29A:
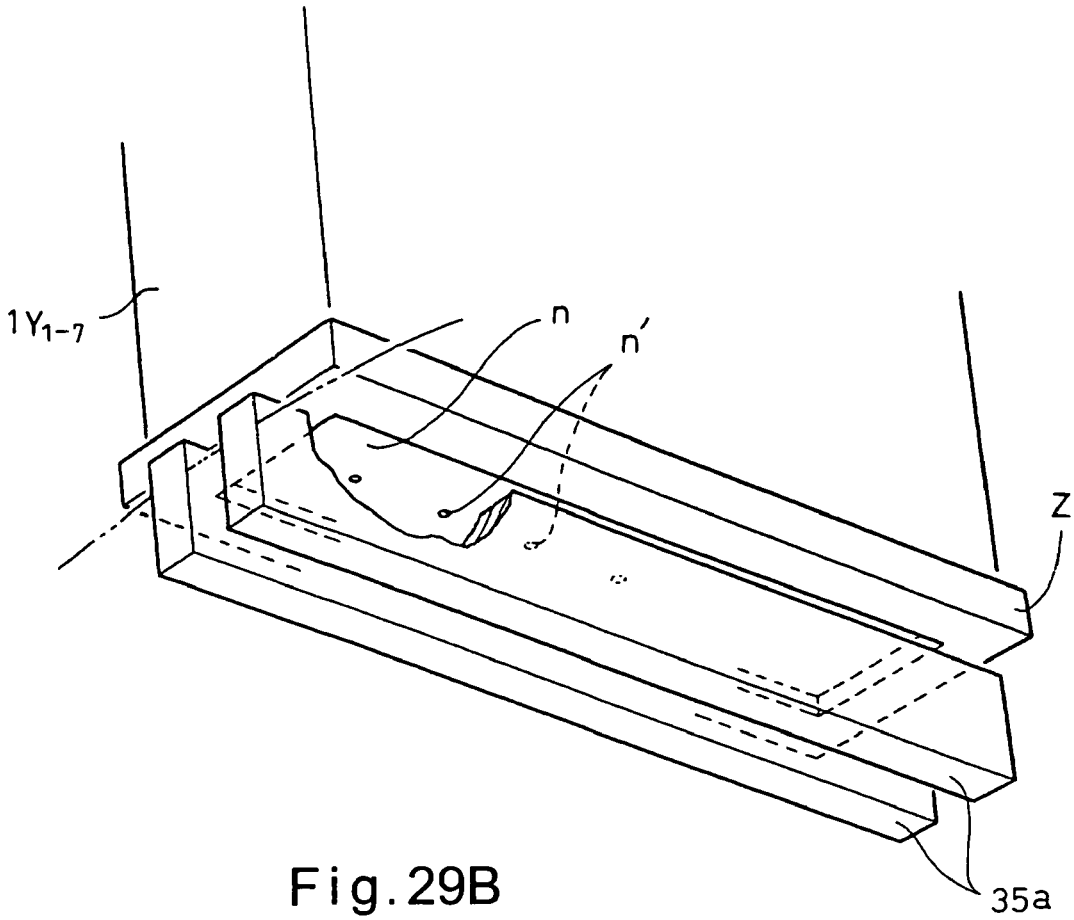
Figure 29B:
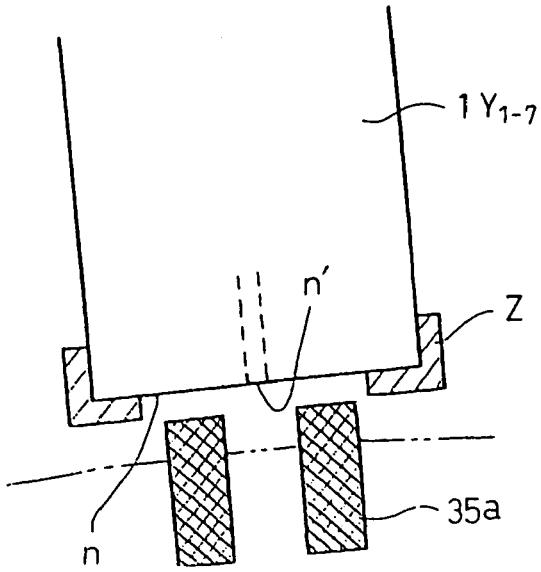

As shown in FIG. 25, the cleaning apparatus B comprises a tray 30 and a suction unit 31 mounted on the tray 30. The tray 30 includes an abutting portion 32 and a bracket 33. The abutting portions 32 are in the form of two domes arranged side by side as shown in FIG. 27. The bracket 33 is provided under the abutting portion 32. Each dome of the abutting portion 32 is formed by arranging long plates in parallel. The long plates each are formed with through holes arranged in staggered fashion so as to align with the short line heads $\mathbf{1}_{Y1\text{-}7}$. Mesh plates 35 as absorbing material are mounted in the through holes. The mesh plates 35 are vertically movably mounted. They are pushed up by springs and meshes 35*a* are kept pressed against a protecting plate Z mounted to the nozzle surface n of the line heads $\mathbf{1}_{Y1\text{-}7}$ as shown in FIG. 29(*a*). The protecting plate Z is a frame mounted around the nozzle surface n of the short line head $\mathbf{1}_{Y1\text{-}7}$. This arrangement makes it possible to keep the gap between the nozzle surface n and the mesh plate 35 to a proper size easily with good dimensional accuracy (in comparison with a fixed mesh disclosed in Japanese patent publication 2000-177147). By arranging two meshes 35*a* at both sides of nozzles n' as shown in FIG. 29(*b*), the meshes can absorb the dripping ink (by capillary action), thereby preventing scattering of ink. Therefore, even if the line head $\mathbf{1}_{Y1\text{-}7}$ is inclined as shown in FIG. 29(*b*), the meshes can absorb ink reliably.

At one end (drum side) of the tray 30, a suction unit 31 is provided which has suction ports directed upward so as to oppose the nozzle surface n of the line head $\mathbf{1}_{Y1\text{-}7}$. Also, the suction ports are connected to a suction pump (not shown) to suck ink.

The tray 30 is coupled with a parallel translation means 37 which has a ball screw 38. As shown in FIG. 25, the ball screw 38 extends from the cleaning apparatus B side to the printer proper A and has a slider coupled with the tray 30. By driving the ball screw 38 by a motor, the tray 30 can be moved to and from the cleaning position (where the mesh plates 35 oppose the line head $\mathbf{1}_{Y1\text{-}7}$) on the drum 2 as shown in FIG. 25. By providing a sensor for positioning and using a stepping motor as a motor, a required positioning accuracy is achieved.

Figure 30:
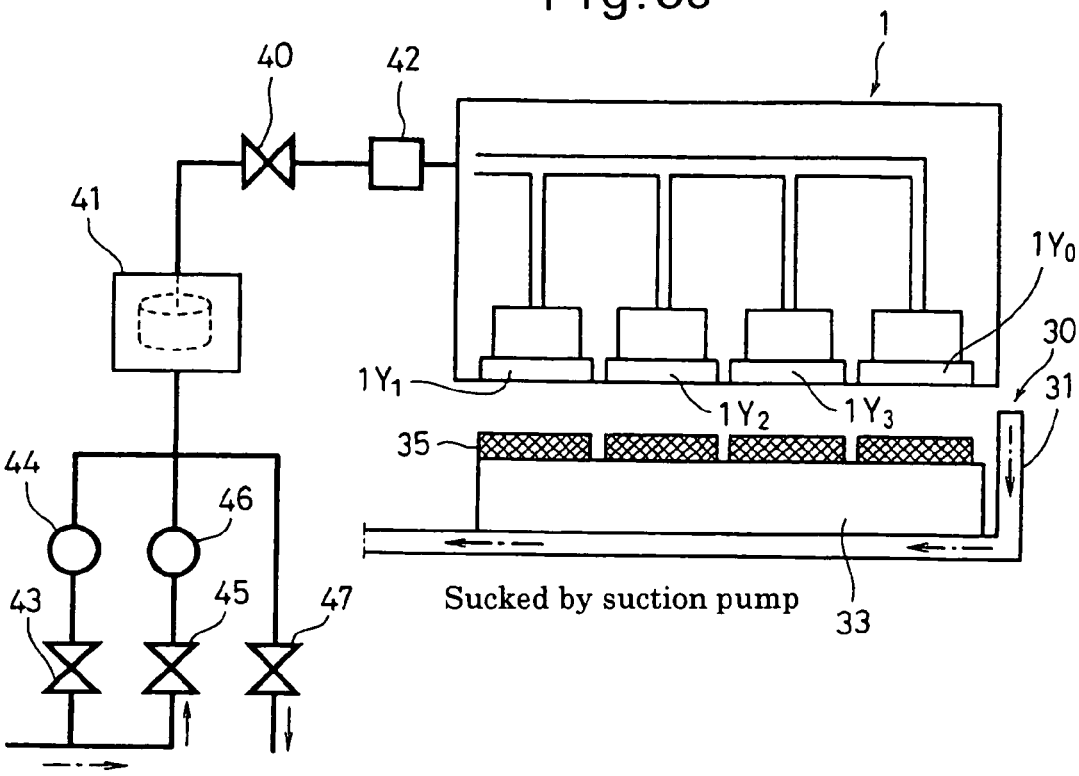

As for the ink supply system of the inkjet printer of such a structure, as shown in FIG. 30 (carriage 10 of yellow 1Y for example), each line head $\mathbf{1}_{Y1\text{-}7}$ of the carriage 10 is connected through an ink supply valve 40 to an ink tank 41.

A pressure sensor 42 is provided between the ink supply valve 40 and the line head $\mathbf{1}_{Y1\text{-}7}$ to detect the inkjet pressure.

To the ink tank 41, three valves are connected. The first valve 43 is a main valve for ink supply pressure connected to a compressor (not shown). It is connected to the ink tank 41 through a regulator 44 for setting the ink supply pressure. The second valve 45 is a main valve for purge pressure connected to the ink tank 41 through a regulator 46 for setting the purge pressure. The third valve 47 is a main valve for regulating negative pressure, which is connected directly to the ink tank 41.

In this ink supply line, ink is supplied by applying a pressure to the ink tank 41 by the compressor. When the ink supply valve 40 is opened, the ink in the pressurized ink tank 41 is supplied to the line head $\mathbf{1}_{Y1\text{-}7}$ of the carriage 10. The ink supply valve 40 is normally kept closed during printing and the nozzle surface n of the line head $\mathbf{1}_{Y1\text{-}7}$ is kept under negative pressure. The degree of negative pressure increases gradually as the ink is jetted from the line head $\mathbf{1}_{Y1\text{-}7}$. During printing, the negative pressure is detected by the pressure sensor 42. When it raises above a predetermined value, the ink supply valve 40 is opened to decrease the negative pressure to a proper level (if the negative pressure is too high, ink will not be jetted).

The pressure applied to the ink tank 41 can be selected from among several values by means of the regulator 44 for setting the ink supply pressure and the main valve 43 for ink supply pressure. It can be set to a pressure suited to the matter 1 to be printed.

For reference, in ordinary printing, the regulator 44 for setting the ink supply pressure is set to about 20 kPa and the ink supply pressure is regulated by use of the main valve 43.

In the cleaning step described below, with the regulator 46 for setting purge pressure set to about 40 kPa, purge pressure is applied to the ink tank 41 by the main valve 45 for purge pressure.

Also, when setting the negative pressure, the main valve 47 for regulating the negative pressure is opened to make the ink tank 41 to atmospheric pressure to bring the nozzle surface of line head $\mathbf{1}_{Y1\text{-}7}$ under negative pressure. By doing so, when the ink supply valve 40 is opened, the entire ink piping will be kept under negative pressure by the weight of ink itself.

The structure is as described above. Next, a cleaning operation of this printer will be described below.

With this printer, when cleaning is started, all the main valves shown in FIG. 30 (ink supply pressure valve 43, purge pressure valve 45 and negative pressure regulating valve 47) and the ink supply valve 40 are closed. Then the wing frame F of the printer proper A is opened to its uppermost position. A gap is formed between the line head 1 and the drum 2 as shown in FIG. 25. By the parallel translation means 37, the tray 30 is moved to the cleaning position (where the tray is under the line head). This state is shown in FIG. 27.

Figure 31:
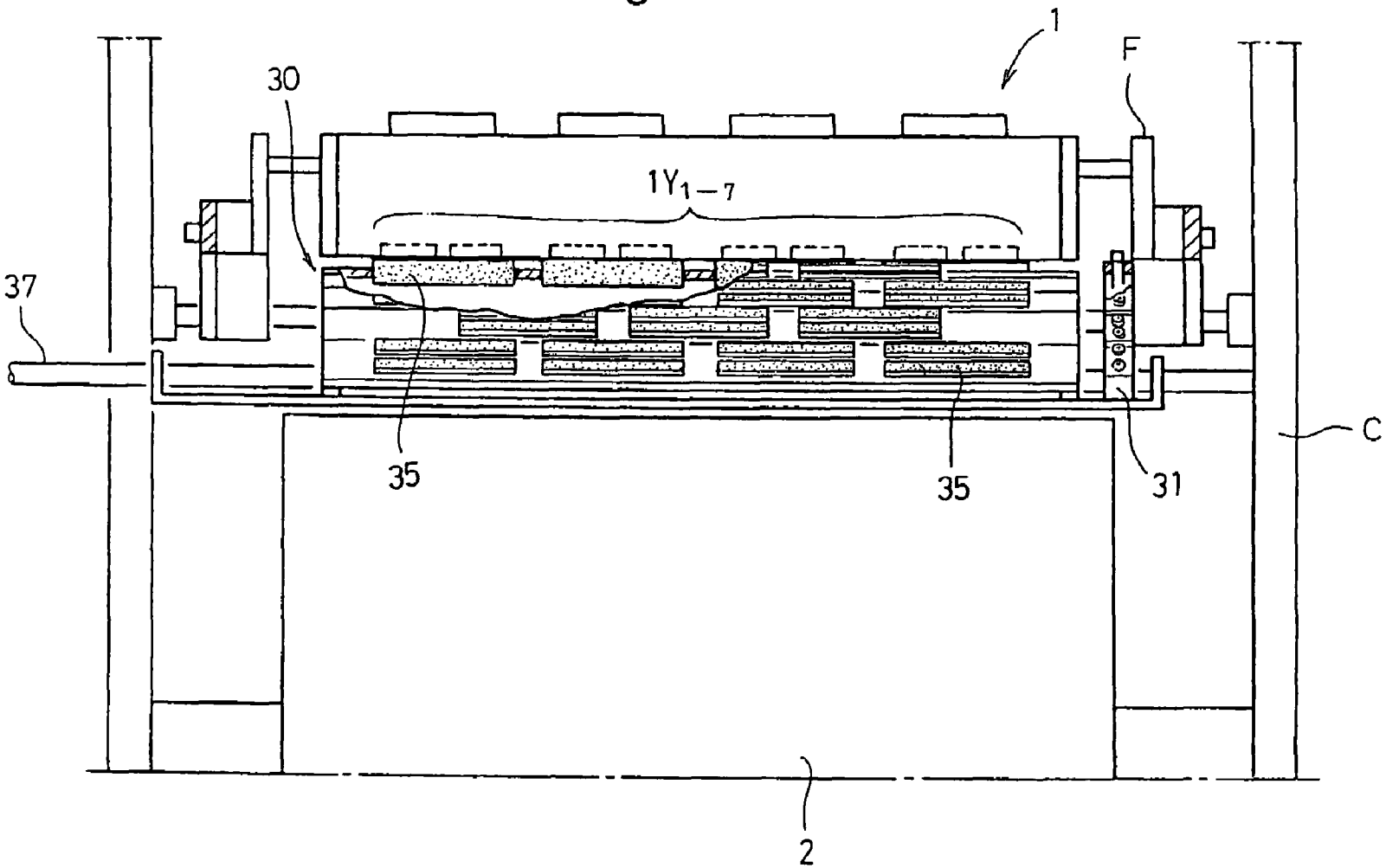
Figure 32:
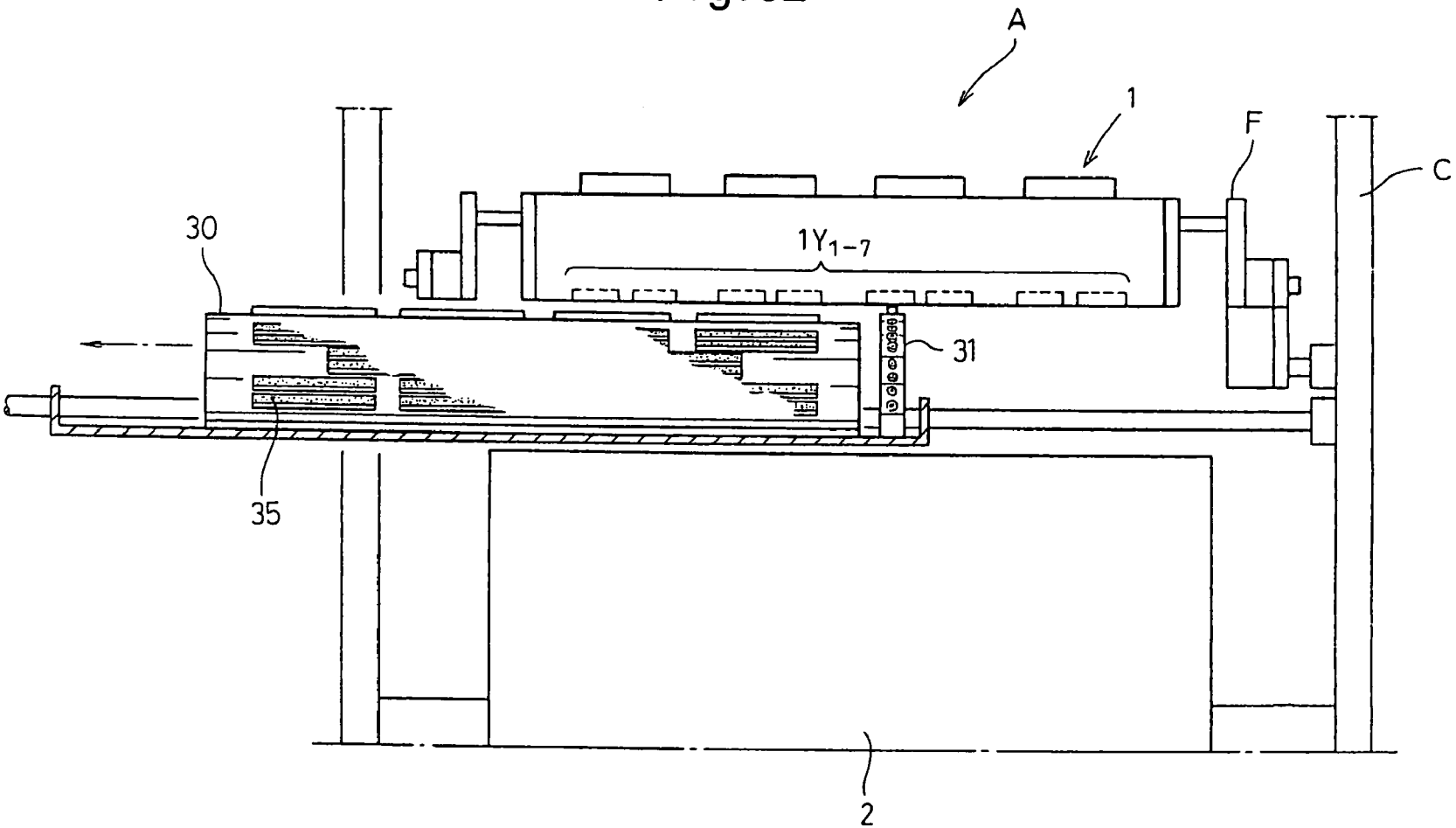
Figure 33:
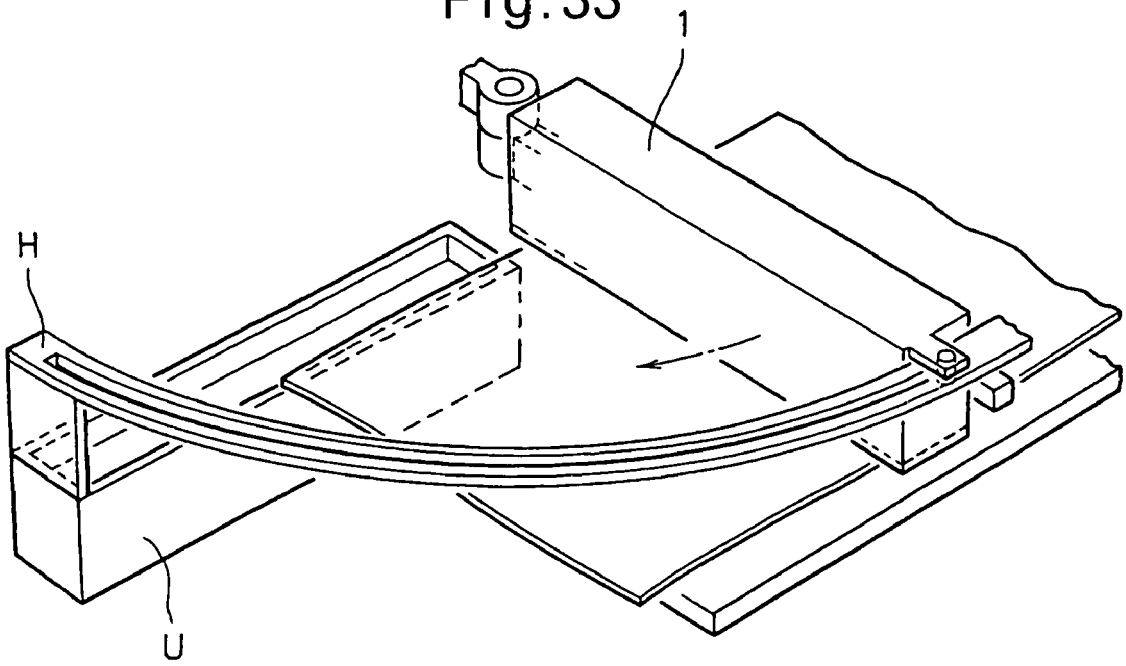

When the tray 30 reaches the cleaning position, the wing frame F is lowered to the purge position (where the nozzle surface n of the line head $\mathbf{1}_{Y1-7}$ is in contact with the mesh 35*a* of the mesh plate 35. Or there may be a slight gap. See letter a in FIG. 27.) When the frame F lowers to the position shown in FIG. 31, the main valve 45 for purge pressure is opened. Now the purge pressure is applied to the ink tank 41. When the ink supply valve 40 is opened, the purge pressure is applied to the line head $\mathbf{1}_{Y1-7}$ and ink is pushed out of the nozzle surface n. The ink pushed out is received by the bracket 33 through the mesh 35*a*.

After ink has been pushed out (purged) for a preset time, the ink supply valve 40 is closed. Because the pressure is still positive just after closed, ink will ooze out for some time. So the main valve 45 for purge pressure is closed.

Next, the main valve 47 for regulating the negative pressure is opened. This will make the ink tank 41 under atmospheric pressure and the piping will be put under negative pressure by the weight of ink itself. Now the ink supply valve 40 is opened. This puts the line head $\mathbf{1}_{Y1-7}$ (nozzle surface n) under negative pressure, thus stopping the oozing out of ink from the nozzle surface. When a predetermined negative pressure is reached, the ink supply valve 40 and the negative pressure regulating valve 47 are closed.

When such a cleaning by ink purging is complete, the wing frame F is raised to a position (b in FIG. 27) for cleaning using the suction unit 31.

When the wing frame is raised to a proper position, the suction pump is operated. Now suction through the suction ports is started. The tray 30 is moved between the printer A and the cleaning apparatus B (may be moved back and forth a plurality of times) to suck the nozzle surface n, thereby sucking ink and dust out of the nozzles n' and cleaning the inside of the nozzle surface n.

After cleaning, the tray 30 is returned into the cleaning apparatus B, the suction pump is stopped, and the wing frames F are lowered to the printing position.

Cleaning by use of the tray 30 makes it possible to clean a plurality of line heads 1 at one time. Also, parallel translating the tray 30 does not require space in comparison with the arrangement in which a plurality of line heads have to be turned for cleaning. No conflict of the line heads will occur and so the structure is simple. Further, ink piping design is simple. By pivoting operation around a shaft, positioning for maintenance and printing is relatively easy and highly accurate.

Further, because the tray 30 is moved not inclined but in parallel, the angle of the tray does not change but is fixed during maintenance and printing. Even if ink remains on the tray 30 after maintenance work, ink will not spill from the tray but be kept thereon reliably.

INDUSTRIAL APPLICABILITY

The line dot recorder according to the present invention can be widely used as a line printer with which a plurality of papers are continuously fed to a drum and mass-printed by jet nozzles.

The invention claimed is:

1. A line dot recorder comprising:

a rotary drum having an outer periphery of a sufficient length to mount a printing medium thereon;

a drum driving means for rotating said rotary drum; and a recording head provided close to an outer periphery of said rotary drum and having a plurality of recording elements in the form of jet nozzle orifices arranged in lines in a main scanning direction at intervals corresponding to a predetermined pixel density in a proper print area, wherein the outer periphery of said rotary drum has a length which is N (an integer of two or more) times a base length which is a length in a sub-scanning direction of the printing medium and is sufficient to mount and hold N sheets of the printing medium, and said rotary drum is arranged to be rotated so as to move the printing medium relative to said recording head in the sub-scanning direction at a speed greater than a standard speed such that dot recording to pixels of the printing medium of a regular length will be done with a predetermined pixel density at an operating period of said recording head, and such that dot recording to the pixels is carried out by N-pass printing with N rotations of said rotary drum to form images on the printing medium.

2. A line dot recorder as claimed in claim 1, wherein the speed greater than said standard speed is N times said standard speed in the sub-scanning direction of the printing medium.

3. A line dot recorder as claimed in claim 1, further comprising:

a head moving means coupled with said recording head for moving said recording head relative to said rotary drum in the main scanning direction and a direction opposite thereto, wherein said recording head is arranged to be moved relative to said rotary drum to N positions including a base position and the recording elements corresponding to an area to be dot recorded on the printing medium are operable in each of the N positions to form images.

4. A line dot recorder as claimed in claim 1, further comprising:

a paper supply means for supplying paper as the printing medium to said rotary drum at a predetermined paper supply position every predetermined revolutions of said rotary drum;

a paper mounting/holding means for mounting and holding N sheets of the printing medium on said rotary drum; and a paper delivery means for delivering the mounted printing medium at a predetermined paper delivery position every predetermined revolutions of said rotary drum, whereby said paper supply means, said paper mounting/holding means and said paper delivery means are arranged to supply, mount, hold an deliver multiple sheets of the printing medium to and from said rotary drum one after another at predetermined timings, and to form uniform-quality images continuously on said multiple sheets of the printing medium.

5. A line dot recorder as claimed in claim 1, wherein said recording head has a plurality of recording elements corresponding to pixels in each of N positions, and even-numbered ones or odd-numbered ones of said recording elements can be operated for dot recording for each of said N positions.

6. A line dot recorder as claimed in claim 1, wherein said printing medium is a long sheet of a length which is N times a length in the sub-scanning direction of a maximum size paper, and an image of a size which is equal to N times an image formed on said maximum size paper is formed on said long sheet.

7. A line dot recorder as claimed in claim 1, wherein said recording head comprises a line head having recording elements in the form of jet nozzles, wherein a tray is provided between said drum and said line head so as to be parallel with the shaft of said drum, said tray being inserted between said drum and said line head for cleaning of said line head, and wherein a translating means for pulling out said tray is provided.

8. A line dot recorder as claimed in claim 2, further comprising:

a paper supply means for supplying paper as the printing medium to said rotary drum at a predetermined paper supply position every predetermined revolutions of said rotary drum;

a paper mounting/holding means for mounting and holding N sheets of the printing medium on said rotary drum; and a paper delivery means for delivering the mounted printing medium at a predetermined paper delivery position every predetermined revolutions of said rotary drum, whereby said paper supply means, said paper mounting/holding means and said paper delivery means are arranged to supply, mount, hold an deliver multiple sheets of the printing medium to and from said rotary drum one after another at predetermined timings, and to form uniform-quality images continuously on said multiple sheets of the printing medium.

9. A line dot recorder as claimed in claim 2, wherein said printing medium is a long sheet of a length which is N times a length in the sub-scanning direction of a maximum size paper, and an image of a size which is equal to N times an image formed on said maximum size paper is formed on said long sheet.

10. A line dot recorder as claimed in claim 2, further comprising:

a head moving means coupled with said recording head for moving said recording head relative to said rotary drum in the main scanning direction and a direction opposite thereto, wherein said recording head is arranged to be moved relative to said rotary drum to N positions including a base position and the recording elements corresponding to an area to be dot recorded on the printing medium are operable in each of the N positions to form images.

11. A line dot recorder as claimed in claim 3, further comprising:

a paper supply means for supplying paper as the printing medium to said rotary drum at a predetermined paper supply position every predetermined revolutions of said rotary drum;

a paper mounting/holding means for mounting and holding N sheets of the printing medium on said rotary drum; and a paper delivery means for delivering the mounted printing medium at a predetermined paper delivery position every predetermined revolutions of said rotary drum, whereby said paper supply means, said paper mounting/holding means and said paper delivery means are arranged to supply, mount, hold an deliver multiple sheets of the printing medium to and from said rotary drum one after another at predetermined timings, and to form uniform-quality images continuously on said multiple sheets of the printing medium.

12. A line dot recorder as claimed in claim 3, wherein in moving said recording head in the main scanning direction and in an opposite direction to N positions including said base position, said recording head is arranged to be moved to and stopped at positions such that distances between any adjacent positions in a maximum moving distance in the main scanning direction will be uniform, and said head moving means is coupled with said recording head so that said recording head can be moved for such a distance that a plurality of print images can be formed.

13. A line dot recorder as claimed in claim 4, wherein the recording elements are operable to perform dot recording to pixels of N sheets of the printing medium such that an order of printed images will be the same while said multiple sheets of the printing medium are being supplied, mounted, held and delivered, whereby images are formed so that the order of printed images on the N sheets of the printing medium will be the same.

14. A line dot recorder as claimed in claim 4, wherein, recording elements of the nozzles are operable to perform dot recording to pixels for N sheets of the printing medium while said multiple sheets of the printing medium are being supplied, mounted, held and delivered, whereby images are formed by the same nozzles for print images on N sheets of the printing medium.

15. A line dot recorder as claimed in claim 4, wherein said paper supply means and said paper delivery means are arranged to supply and deliver paper to said rotary drum once per (1+1/N) rotation of said rotary drum.

16. A line dot recorder as claimed in claim 7, further comprising:

an elevating means for moving said line head vertically to expand a distance between said line head and said drum.

17. A line dot recorder as claimed in claim 7, further comprising:

a suction port provided at a drum side end of said tray, said suction port being connected to a suction pump so as to suck ink from the nozzles of said line head.

18. A line dot recorder as claimed in claim 8, wherein the recording elements are operable to perform dot recording to pixels of N sheets of the printing medium such that an order of printed images will be the same while said multiple sheets of the printing medium are being supplied, mounted, held and delivered, whereby images are formed so that the order of printed images on the N sheets of the printing medium will be the same.

19. A line dot recorder as claimed in claim 8, wherein, recording elements of the nozzles are operable to perform dot recording to pixels for N sheets of the printing medium while said multiple sheets of the printing medium are being supplied, mounted, held and delivered, whereby images are formed by the same nozzles for print images on N sheets of the printing medium.

20. A line dot recorder as claimed in claim 8, wherein said paper supply means and said paper delivery means are arranged to supply and deliver paper to said rotary drum once per (1+1/N) rotation of said rotary drum.

21. A line dot recorder as claimed in claim 11, wherein the recording elements are operable to perform dot recording to pixels of N sheets of the printing medium such that an order of printed images will be the same while said multiple sheets of the printing medium are being supplied, mounted, held and delivered, whereby images are formed so that the order of printed images on the N sheets of the printing medium will be the same.

22. A line dot recorder as claimed in claim 11, wherein, recording elements of the nozzles are operable to perform dot recording to pixels for N sheets of the printing medium while said multiple sheets of the printing medium are being supplied, mounted, held and delivered, whereby images are formed by the same nozzles for print images on N sheets of the printing medium.

23. A line dot recorder as claimed in claim 11, wherein said paper supply means and said paper delivery means are arranged to supply and deliver paper to said rotary drum once per (1+1/N) rotation of said rotary drum.

24. A line dot recorder as claimed in claim 16, wherein said elevating means is a wing having a fulcrum shaft at both sides of which a plurality of line heads are arranged in parallel, said wing being arranged to be opened and closed around said fulcrum shaft so as to expand the distance between said drum and said line head.

* * * * *